US007476093B2

(12) United States Patent
Hosono

(10) Patent No.: US 7,476,093 B2
(45) Date of Patent: Jan. 13, 2009

(54) OIL PUMP ROTOR ASSEMBLY

(75) Inventor: Katsuaki Hosono, Niigata (JP)

(73) Assignee: Mitsubishi Materials PMG Corporation, Niigata (JP)

( * ) Notice: Subject to any disclaimer, the term of this patent is extended or adjusted under 35 U.S.C. 154(b) by 279 days.

(21) Appl. No.: 10/556,742

(22) PCT Filed: Aug. 10, 2004

(86) PCT No.: PCT/JP2004/011479

§ 371 (c)(1),
(2), (4) Date: Oct. 19, 2006

(87) PCT Pub. No.: WO2005/015022

PCT Pub. Date: Feb. 17, 2005

(65) Prior Publication Data

US 2008/0085208 A1 Apr. 10, 2008

(30) Foreign Application Priority Data

Aug. 12, 2003 (JP) ..... 2003-207347

(51) Int. Cl.
*F01C 21/10* (2006.01)
*F03C 2/00* (2006.01)
*F04C 2/00* (2006.01)

(52) U.S. Cl. ..... 418/150; 418/171

(58) Field of Classification Search ..... 418/150, 418/166, 171
See application file for complete search history.

(56) References Cited

U.S. PATENT DOCUMENTS

| | | | | |
|---|---|---|---|---|
| 5,368,455 | A | 11/1994 | Eisenmann | |
| 6,077,059 | A * | 6/2000 | Hosono | 418/150 |
| 6,244,843 | B1 * | 6/2001 | Kosuge | 418/150 |
| 6,244,863 | B1 | 6/2001 | Rawicz et al. | |
| 6,887,056 | B2 * | 5/2005 | Hosono | 418/150 |
| 7,118,359 | B2 * | 10/2006 | Hosono | 418/150 |

FOREIGN PATENT DOCUMENTS

| | | |
|---|---|---|
| JP | 5-256268 A | 10/1993 |
| JP | 2003-56473 A | 2/2003 |

OTHER PUBLICATIONS

Patent Abstracts of Japan for JP5-256268 published Oct. 5, 1993.
Patent Abstracts of Japan for JP2003-056473 published Feb. 26, 2003.
International Search Report for PCT/JP2004/011479 completed Nov. 26, 2004.

* cited by examiner

*Primary Examiner*—Theresa Trieu
(74) *Attorney, Agent, or Firm*—Darby & Darby P.C.

(57) ABSTRACT

A rotor pump assembly is disclosed which reduces noise emitted from an oil pump while preventing pumping performance and mechanical efficiency thereof from being decreased by properly forming the profiles of teeth of an inner rotor and an outer rotor which are engageable with each other. The tooth profile of an inner rotor and/or an outer rotor has curved lines obtained by dividing a cycloid curve into two segments to be separated from each other, and in which the separated segments are smoothly connected to each other using a straight line or a curve.

3 Claims, 9 Drawing Sheets

OIL PUMP ROTOR ASSEMBLY

CROSS-REFERENCE TO PRIOR APPLICATION

This is a U.S. National Phase Application under 35 U.S.C. §371 of International Patent Application No. PCT/JP2004/011479 filed Aug. 10, 2004, and claims the benefit of Japanese Patent Application No. 2003-207347 filed Aug. 12, 2003, both of which are incorporated by reference herein. The International Application was published in Japanese on Feb. 17, 2005 as WO 2005/015022 A1 under PCT Article 21(2).

TECHNICAL FIELD

This invention relates to an oil pump rotor assembly used in an oil pump which draws and discharges fluid by volume change of cells formed between an inner rotor and an outer rotor.

BACKGROUND ART

Conventionally, internal gear oil pumps, which are generally compact and simply constructed, are widely used as pumps for lubrication oil in automobiles and as oil pumps for automatic transmissions, etc. Such an oil pump comprises an inner rotor formed with "n" external teeth (hereinafter "n" is a natural number), an outer rotor formed with "n+1" internal teeth which are engageable with the external teeth, and a casing in which a suction port for drawing fluid and a discharge port for discharging fluid are formed, and fluid is drawn and is discharged by rotation of the inner rotor which produces changes in the volumes of cells formed between the inner and outer rotors.

With regard to such internal gear oil pumps, in order to reduce pump noise and to increase mechanical efficiency, various technical means have been employed such as setting a tip clearance having appropriate size between the tooth tips of the inner and outer rotors, modifying tooth profiles which are formed using, for example, cycloid curves, etc. More specifically, in some oil pumps, the profiles of the teeth of the outer rotor are uniformly cut so as to ensure a clearance between the surfaces of the teeth of the inner and outer rotors, or alternatively, the cycloid curve defining the shape of the teeth are partially flattened so as to modify the tooth profiles (see, for example, Patent Document 1)

[Patent Document 1]

Japanese Unexamined Patent Application Publication No. 05-256268.

However, in such conventional means of setting a tip clearance by uniformly cutting the profiles of the teeth, or flattening the cycloid curve by adjusting the diameter of a rolling circle that generates the cycloid curve or by forming a portion of the tooth profile using a straight line, even though a sufficient tip clearance may be obtained, a clearance between the tooth surfaces is also increased, which leads to problems such as increase in transmission torque loss due to play between the rotors or due to slippage between the tooth surfaces, pump noise due to impacts between the rotors, etc.

Moreover, when inappropriate clearance is provided between the tooth surfaces by the adjustment of tooth surface profiles, hydraulic pulsation may be produced or increased, which may lead to problems such as decrease in pumping performance or mechanical efficiency, pump noise, etc.

DISCLOSURE OF THE INVENTION

Based on the above problems, an object of the present invention is to reduce noise emitted from an oil pump while preventing pumping performance and mechanical efficiency thereof from being decreased by properly forming the profiles of teeth of an inner rotor and an outer rotor of the oil pump.

In order to achieve the above object, in an oil pump rotor assembly of the present invention, the width of a tooth tip is increased by separating a cycloid curve, which defines the tooth tip, along the circumference of a base circle or along a tangential line of the midpoint of the tooth tip, whereby a gap (or clearance) between the tooth surfaces, which is defined in the direction of tooth width when the rotors engage each other, is decreased.

That is, in an oil pump rotor assembly according to one aspect of the invention, the profile of a tooth space of the inner rotor is formed such that a hypocycloid curve, which is generated by rolling an inscribed-rolling circle Bi along a base circle Di without slippage, is equally divided into two external tooth curve segments. The obtained two external tooth curve segments are separated from each other by a predetermined distance along the circumference of the base circle Di and/or along a tangential line of the hypocycloid curve drawn at the midpoint thereof, and the separated two external tooth curve segments are smoothly connected to each other using a curved line or a straight line.

In this oil pump rotor assembly, the profile of a tooth tip of the inner rotor is formed based on an epicycloid curve which is generated by rolling a circumscribed-rolling circle Ai along a base circle Di without slippage. Further, each of the tooth profiles of the outer rotor is formed such that the profile of the tooth space thereof is formed using an epicycloid curve which is generated by rolling a circumscribed-rolling circle Ao along a base circle Do without slippage, and the profile of the tooth tip thereof is formed using a hypocycloid curve which is generated by rolling an inscribed-rolling circle Bo along the base circle Do without slippage In such an oil pump rotor assembly, the inner and outer rotors are formed such that the following equations are satisfied:

$$\phi Ai=\phi Ao;$$

$$\phi Bi=\phi Bo;$$

$$\phi Ai+\phi Bi=\phi Ao+\phi Bo=2e;$$

$$\phi Do=(n+1)\cdot(\phi Ao+\phi Bo);$$

$$\phi Di=n\cdot(\phi Ai+\phi Bi);$$

$$n\cdot\phi Do=(n+1)\cdot\phi Di,$$

where "n" is the number of teeth of the inner rotor, $\phi$Di is the diameter of the base circle Di, $\phi$Ai is the diameter of the circumscribed-rolling circle Ai, $\phi$Bi is the diameter of the inscribed-rolling circle Bi, "n+1" is the number of teeth of the outer rotor, $\phi$Do is the diameter of the base circle Do, $\phi$Ao is the diameter of the circumscribed-rolling circle Ao, $\phi$Bo is the diameter of the inscribed-rolling circle Bo, and "e" is an eccentric distance between the inner and outer rotors, and such that the following equation is satisfied:

$$0.01\ [\mathrm{mm}]\leqq\alpha\leqq0.08\ [\mathrm{mm}]$$

where "$\alpha$" is the distance between the separated external tooth curve segments in the inner rotor.

In an oil pump rotor assembly according to a second aspect of the invention, the profile of a tooth space of the outer rotor is formed such that an epicycloid curve, which is generated by rolling a circumscribed-rolling circle Ao along a base circle Do without slippage, is equally divided into two internal tooth curve segments. The obtained two internal tooth curve segments are separated from each other by a predetermined distance along the circumference of the base circle Do and/or along a tangential line of the epicycloid curve drawn at the midpoint thereof, and the separated two internal tooth curve segments are smoothly connected to each other using a curved line or a straight line.

In this oil pump rotor assembly, the profile of a tooth tip of the outer rotor is formed based on a hypocycloid curve which is formed by rolling an inscribed-rolling circle Bo along a base circle Do without slippage.

Further, each of the tooth profiles of the inner rotor is formed such that the profile of the tooth tip thereof is formed using an epicycloid curve which is generated by rolling a circumscribed-rolling circle Ai along a base circle Di without slippage, and the profile of the tooth space thereof is formed using a hypocycloid curve which is generated by rolling an inscribed-rolling circle Bi along the base circle Di without slippage.

In such an oil pump rotor assembly, the inner and outer rotors are formed such that the following equations are satisfied:

$$\phi Ai=\phi Ao;$$

$$\phi Bi=\phi Bo;$$

$$\phi Ai=\phi Bi=\phi Ao+\phi Bo=2e;$$

$$\phi Do=(n+1)\cdot(\phi Ao+\phi Bo);$$

$$\phi Di=n\cdot(\phi Ai+\phi Bi);$$

$$\phi Do=(n+1)\cdot\phi Di,$$

where "n" is the number of teeth of the inner rotor, ϕDi is the diameter of the base circle Di, ϕAi is the diameter of the circumscribed-rolling circle Ai, ϕBi is the diameter of the inscribed-rolling circle Bi, "n+1" is the number of teeth of the outer rotor, ϕDo is the diameter of the base circle Do, ϕAo is the diameter of the circumscribed-rolling circle Ao, ϕBo is the diameter of the inscribed-rolling circle Bo, and "e" is an eccentric distance between the inner and outer rotors, and such that the following equation is satisfied:

$$0.01\ [\mathrm{mm}]\leqq\beta\leqq0.08\ [\mathrm{mm}]$$

where "β" is the distance between the separated internal tooth curve segments in the outer rotor.

In an oil pump rotor assembly according to a third aspect of the invention, the profile of a tooth space of the inner rotor is formed such that a hypocycloid curve, which is generated by rolling an inscribed-rolling circle Bi along a base circle Di without slippage, is equally divided into two external tooth curve segments. The obtained two external tooth curve segments are separated from each other by a predetermined distance along the circumference of the base circle Di and/or along a tangential line of the hypocycloid curve drawn at the midpoint thereof, and the separated two external tooth curve segments are smoothly connected to each other using a curved line or a straight line. Further, the profile of a tooth space of the outer rotor is formed such that an epicycloid curve, which is generated by rolling a circumscribed-rolling circle Ao along a base circle Do without slippage, is equally divided into two internal tooth curve segments. The obtained two internal tooth curve segments are separated from each other by a predetermined distance along the circumference of the base circle Do and/or along a tangential line of the epicycloid curve drawn at the midpoint thereof, and the separated two internal tooth curve segments are smoothly connected to each other using a curved line or a straight line.

In this oil pump rotor assembly, the profile of a tooth tip of the inner rotor is formed based on an epicycloid curve which is generated by rolling a circumscribed-rolling circle Ai along a base circle Di without slippage.

Further, the profile of a tooth tip of the outer rotor is formed based on a hypocycloid curve which is generated by rolling an inscribed-rolling circle Bo along a base circle Do without slippage.

In such an oil pump rotor assembly, the inner and outer rotors are formed such that the following equations are satisfied:

$$\phi Ai=\phi Ao;$$

$$\phi Bi=\phi Bo;$$

$$\phi Ai+\phi Bi=\phi Ao+\phi Bo=2e;$$

$$\phi Do=(n+1)\cdot(\phi Ao+\phi Bo);$$

$$\phi Di=n\cdot(\phi Ai+\phi Bi);$$

$$n\cdot\phi Do=(n+1)\cdot\phi Di,$$

where "n" is the number of teeth of the inner rotor, ϕDi is the diameter of the base circle Di, ϕAi is the diameter of the circumscribed-rolling circle Ai, ϕBi is the diameter of the inscribed-rolling circle Bi, "n+1" is the number of teeth of the outer rotor, ϕDo is the diameter of the base circle Do, ϕAo is the diameter of the circumscribed-rolling circle Ao, ϕBo is the diameter of the inscribed-rolling circle Bo, and "e" is an eccentric distance between the inner and outer rotors, and such that the-following equation is satisfied:

$$0.01\ [\mathrm{mm}]\leqq\alpha\leqq0.08\ [\mathrm{mm}]$$

$$0.01\ [\mathrm{mm}]\leqq\beta\leqq0.08\ [\mathrm{mm}]$$

where "α" is the distance between the separated external tooth curve segments in the inner rotor, and "β" is the distance between the separated internal tooth curve segments in the outer rotor.

REFERENCE NUMERALS

Figure 1:
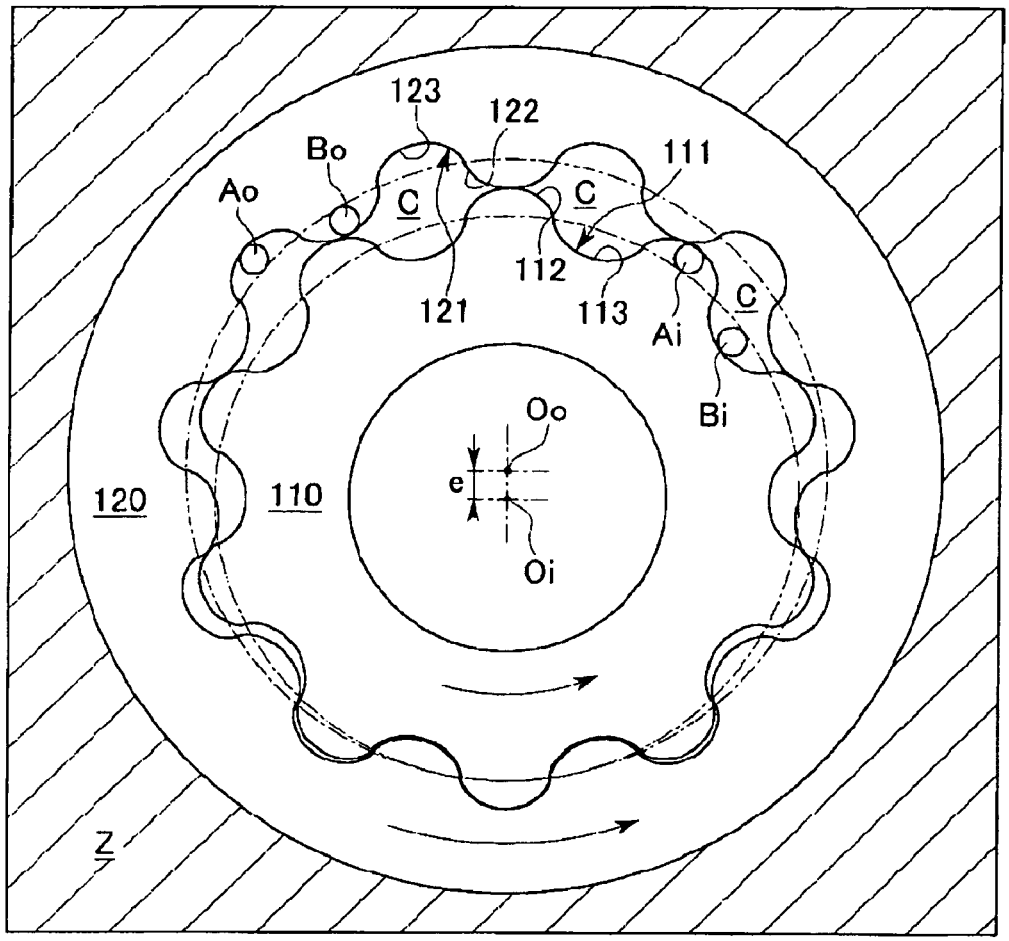
FIG. 1 is a diagram showing a first embodiment of an oil pump rotor assembly according to the present invention.

110, 210, 310, 410 inner rotor
111, 211, 311, 411 external teeth
112, 312, 412 tooth tip
113, 213, 313, 413 tooth space
114, 214, 314, 414 complementary line
115 overlap portion
116*a*, 216*a*, 316*a*, 416*a* curve segment
116*b*, 216*b*, 316*b*, 416*b* curve segment
117*a*, 217*a*, 317*a*, 417*a* external tooth curve segment
117*b*, 217*b*, 317*b*, 417*b* external tooth curve segment
120, 220, 320, 420 outer rotor
121, 221, 321, 421 internal teeth
122, 222, 322, 422 tooth tip
123, 223, 323, 423 tooth space
124, 224, 324, 424 complementary line
125 overlap portion
126*a*, 226*a*, 326*a*, 426*a* curve segment
126*b*, 226*b*, 326*b*, 426*b* curve segment
127*a*, 227*a*, 327*a*, 427*a* internal tooth curve segment
127*b*, 227*b*, 327*b*, 427*b* internal tooth curve segment

BEST MODE FOR CARRYING OUT THE INVENTION

Preferred embodiments of the present invention will now be described with reference to the drawings.

The oil pump shown in FIG. 1 comprises an inner rotor 110 formed with "n" external teeth 111 ("n" is a natural number, and n=10 in this embodiment), an outer rotor 120 formed with "n+1" internal teeth 121 (n+1=11 in this embodiment) which are engageable with the external teeth 111, and a casing Z which accommodates the inner rotor 110 and the outer rotor 120.

Between the tooth surfaces of the inner rotor 110 and outer rotor 120, there are formed plural cells C in the direction of rotation of the inner and outer rotors 110 and 120. Each of the cells C is delimited at a front portion and at a rear portion as viewed in the direction of rotation of the inner rotor 110 and outer rotor 120 by contact regions between the external teeth 111 of the inner rotor 110 and the internal teeth 121 of the outer rotor 120, and is also delimited at either side portions by the casing Z, so that an independent fluid conveying chamber is formed. Each of the cells C moves while the inner rotor 110 and outer rotor 120 rotate, and the volume of each of the cells C cyclically increases and decreases so as to complete one cycle in a rotation.

In the casing Z, there are formed a suction port, which communicates with one of the cells C whose volume increases gradually, and a discharge port, which communicates with one of the cells C whose volume decreases gradually, and fluid drawn into one of the cells C through the suction port is conveyed as the rotors 110 and 120 rotate, and is discharged through the discharge port.

The inner rotor 110 is mounted on a rotational axis so as to be rotatable about the center Oi, and the tooth profile of each of the external teeth 111 of the inner rotor 110 is formed using an epicycloid curve 116, which is generated by rolling a circumscribed-rolling circle Ai (whose diameter is (ϕAi) along the base circle Di (whose diameter is ϕDi) of the inner rotor 110 without slippage, and using a hypocycloid curve 117, which is generated by rolling an inscribed-rolling circle Bi (whose diameter is ϕBi) along the base circle Di without slippage.

The outer rotor 120 is mounted so as to be rotatable about the center Oo in the casing Z, and the center thereof is positioned so as to have an offset (the eccentric distance is "e") from the center Oi. The tooth profile of each of the internal teeth 121 of the outer rotor 120 is formed using an epicycloid curve 127, which is generated by rolling a circumscribed-rolling circle Ao (whose diameter is ϕAo) along the base circle Do (whose diameter is ϕDo) of the outer rotor 120 without slippage, and using a hypocycloid curve 126, which is generated by rolling an inscribed-rolling circle Bo (whose diameter is ϕBo) along the base circle Do without slippage.

The equations which will be discussed below are to be satisfied between the inner rotor 110 and the outer rotor 120. Note that dimensions will be expressed in millimeters.

With regard to the base curves that define tooth profiles of the inner rotor 210, because the length of circumference of the base circle Di must be equal to the length obtained by multiplying the sum of the rolling distance per revolution of the circumscribed-rolling circle Ai and the rolling distance of the inscribed-rolling circle Bi by an integer (i.e., by the number of teeth.

$$\cdot\phi Di = n\cdot\cdot(\phi Ai + \phi Bi)\text{, i.e.,}$$

$$\phi Di = n\cdot(\phi Ai + \phi Bi) \tag{1}$$

Similarly, with regard to the base curves that define tooth profiles of the outer rotor 220, because the length of circumference of the base circle Do of the outer rotor 220 must be equal to the length obtained by multiplying the sum of the rolling distance per revolution of the circumscribed-rolling circle Ao and the rolling distance of the inscribed-rolling circle Bo by an integer (i.e., by the number of teeth).

$$\cdot\phi Do = (n+1)\cdot\cdot(\phi Ao + \phi Bo)\text{, i.e.,}$$

$$\phi Do = (n+1)\cdot(\phi Ao + \phi Bo) \tag{2}$$

next, since the inner rotor 110 engages the outer rotor 120.

$$\phi Ai + \phi Bi = \phi Ao + \phi Bo = 2e \tag{3}$$

Based on the above equations (1), (2), and (3).

$$(n+1)\cdot\phi Di = n\cdot\phi Do \tag{4}$$

Moreover, when the apex of the tooth tip of the external tooth 111 and the apex of the tooth tip of the internal tooth 121 faces each other in a rotational phase advancing by 180° from a rotational phase in which the inner rotor 110 and the outer rotor 120 engage with each other, in order for a clearance not to be formed between both apexes, the following equations are satisfied:

$$\phi Ai = \phi Ao \tag{5}$$ , and $$\phi Bi = \phi Bo \tag{6}$$

The detailed profile of each of the external teeth 111 of the inner rotor 110 and the detailed profile of each of the internal teeth 121 of the outer rotor 120 according to a first embodiment, which are formed based on the curves drawn by the base circles Di and Do, the epicycloid curves Ai and Ao, and the hypocycloid curves Bi and Bo that satisfy the above equations (1) to (6), will be explained with reference to FIGS. 2A to 2C, and FIGS. 3A to 3C.

First, the external teeth 111 of the inner rotor 110 are formed by alternately arranging tooth tips 112 and tooth spaces 113 in the circumferential direction. In order to form the profile of the tooth space 113, first, the hypocycloid curve 117 (FIG. 2A) generated by the inscribed-rolling circle Bi is equally divided at a midpoint 11B thereof into two segments that are designated by curve segments 117*a* and 117*b*, respectively.

Here, the midpoint 11B of the hypocycloid curve 117 is a point that symmetrically divides into two segments the hypocycloid curve 117 which is generated by rolling the inscribed-rolling circle Bi by one turn on the base circle Di of the inner rotor 110 without slippage. In other words, the midpoint 11B is a point that is reached by a specific point on the inscribed-rolling circle Bi which draws the hypocycloid curve 117 when the inscribed-rolling circle Bi rolls a half turn.

Figure 2:
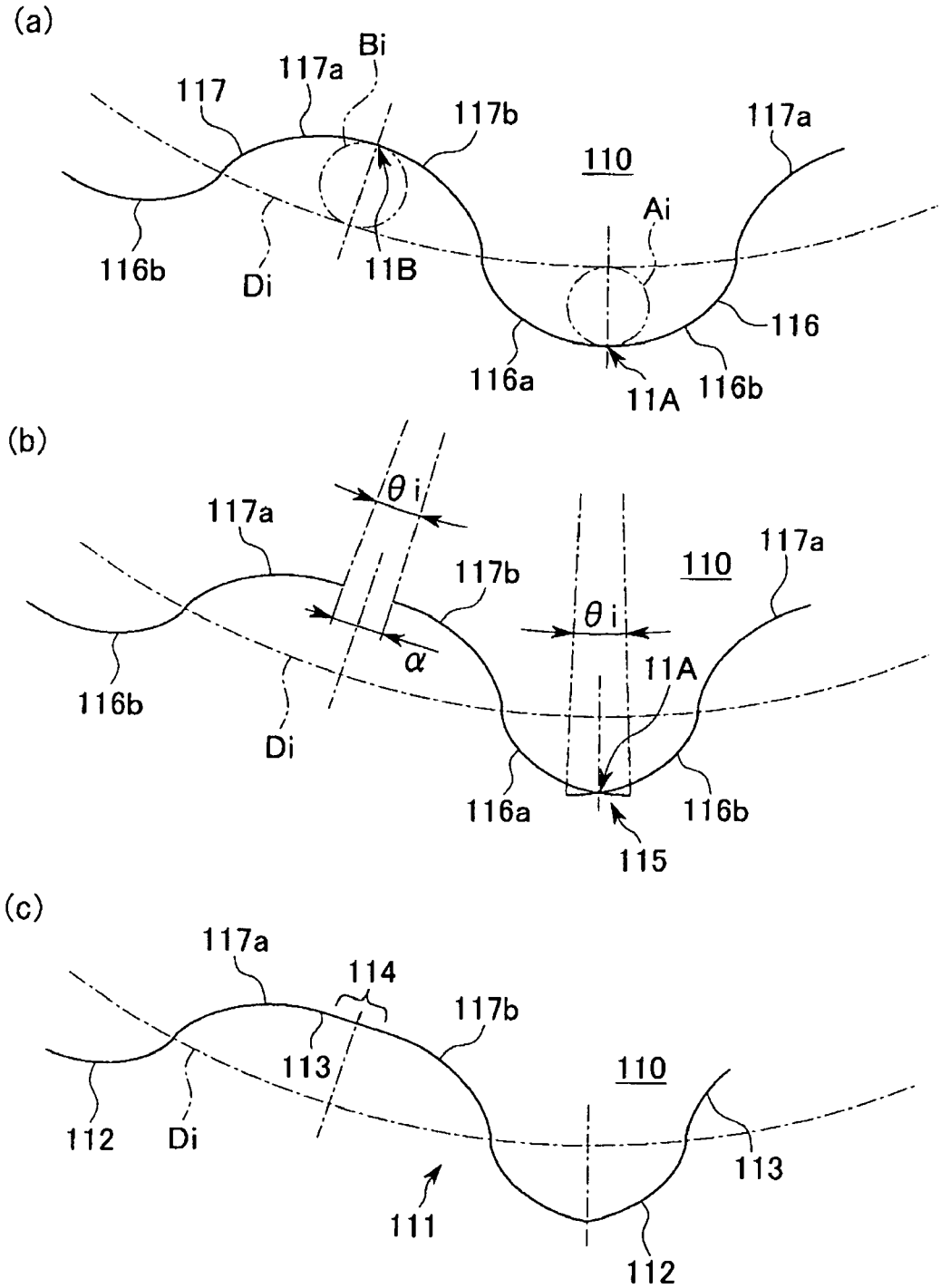
FIG. 2 is a partially enlarged view showing the profiles of external teeth of an inner rotor according to a first embodiment of the present invention.

Next, as shown in FIG. 2B, the external tooth curve segments 117*a* and 117*b* are moved about the center Oi and along the circumference of the base circle Di so that a distance "α" is ensured between the external tooth curve segments 117*a* and 117*b*. At this time, an angle defined by two lines, which are drawn by connecting the center Oi of the base circle Di and the ends of the external tooth curve segments 117*a* and 117*b*, is designated by θi. Here, it is preferable to move two external tooth curve segments 117*a* and 117*b* by equal distance along the circumference, respectively, in a direction away from each other.

As shown in FIG. 2C, the separated ends of the external tooth curve segments 117*a* and 117*b* are connected to each other by a complementary line 114 consisting of a curved line or a straight line. The obtained continuous curve is used as the profile of the tooth surface of the tooth space 113. That is, the tooth space 113 is formed using a continuous curve that includes the external tooth curve segments 117*a* and 117*b*, which are separated from each other, and the complementary line 114 connecting the external tooth curve segment 117*a* with the external tooth curve segment 117*b*.

As a result, the circumferential thickness of the tooth space 113 of the inner rotor 110 is greater than a tooth space which is formed just using the simple hypocycloid curve 117 by an amount corresponding to the angle θi defined by two lines, which are drawn by connecting the center Oi of the base circle Di and the ends of the complementary line 114. In this embodiment, the complementary line 114, which connects the external tooth curve segment 117*a* with the external tooth curve segment 117*b*, is a straight line; however, the complementary line 114 may be a curve.

The circumferential thickness of the tooth space 113 is made to be greater than that of a conventional tooth space as explained above, and on the other hand, in the inner rotor 110 of the present embodiment, the width of the tooth tip 112 is decreased, and tooth surface profiles are smoothly connected to each other over the entirety of the circumference.

In order to form the profile of the tooth tip 112, first, the epicycloid curve 116 (FIG. 2A) generated by the circumscribed-rolling circle Ai is equally divided at a midpoint 11A thereof into two segments that are designated by curve segments 116*a* and 116*b*, respectively.

Here, the midpoint 11A of the epicycloid curve 116 is a point that symmetrically divides into two segments the epicycloid curve 116 which is generated by rolling the circumscribed-rolling circle Ai by one turn on the base circle Di of the inner rotor 110 without slippage. In other words, the midpoint 11A is a point that is reached by a specific point on the circumscribed-rolling circle Ai which draws the epicycloid curve 116 when the circumscribed-rolling circle Ai rolls a half turn.

Next, as shown in FIG. 2B, the curve segments 116*a* and 116*b* are moved along the circumference of the base circle Di so that the ends of the curve segments 116*a* and 116*b* are respectively connected to the ends of the continuous curve that forms the tooth space 113. At this time, the curve segments 116*a* and 116*b* overlap each other while intersecting each other at the midpoint 11A, and an angle, which is defined by both ends of an overlap portion 115 and the center Oi of the base circle Di, equals θi.

As shown in FIG. 2C, the curve segments 116*a* and 116*b* are smoothly connected to each other so as to form a continuous curve that defines the tooth surface profile of the tooth tip 112. Here, it is preferable to move two curve segments 116*a* and 116*b* by equal distance along the circumference, respectively, in a direction toward each other.

As a result, the circumferential width of the tooth tip 112 is less than that of the profile of a tooth tip which is formed just using the simple epicycloid curve 116 by an amount corresponding to the angle θi.

As explained above, in the case of the external teeth 111 of the inner rotor 110, the circumferential thickness of the tooth tip 112 is made to be smaller and the circumferential width of the tooth space 113 is made to be greater when compared with the case in which tooth profiles are formed just using the epicycloid curve 116 and the hypocycloid curve 117 that are generated by the circumscribed-rolling circle Ai and the inscribed-rolling circle Bi, respectively.

Here, the distance α between two external tooth curve segments 117*a* and 117*b* of the inner rotor 110 is set so as to satisfy the following inequality:

$$0.01\ [\mathrm{mm}] \leqq \alpha$$

As a result, a circumferential clearance between the tooth surfaces of the inner rotor 110 and the outer rotor 120 is appropriately ensured, so that the silence property of an oil pump rotor assembly can be sufficiently improved.

Further, the distance α between two external tooth curve segments 117*a* and 117*b* of the inner rotor 110 is set so as to satisfy the following inequality:

$$\alpha \leqq 0.08\ [\mathrm{mm}]$$

As a result, the clearance between the tooth faces between the inner rotor 110 and the outer rotor 120 can be prevented from being too small, and locking in rotation, increase in wear, and reduction in service life of the oil pump rotor assembly can be prevented.

Next, the detailed profile of each of the internal teeth 121 of the outer rotor 120 according to the present embodiment will be explained with reference to FIGS. 3A to 3C.

The internal teeth 121 of the outer rotor 120 are formed by alternately arranging tooth tips 122 and tooth spaces 123 in the circumferential direction.

In order to form the profile of the tooth space 123, first, the epicycloid curve 127 (FIG. 3A) generated by the circumscribed-rolling circle Ao is equally divided at a midpoint 12A thereof into two segments that are designated by curve segments 127*a* and 127*b*, respectively.

Here, the midpoint 12A of the epicycloid curve 127 is a point that symmetrically divides into two segments the epicycloid curve 127 which is generated by rolling the circumscribed-rolling circle Ao by one turn on the base circle Do of the outer rotor 120 without slippage. In other words, the midpoint 12A is a point that is reached by a specific point on the circumscribed-rolling circle Ao which draws the epicycloid curve 127 when the circumscribed-rolling circle Ao rolls a half turn.

Figure 3:
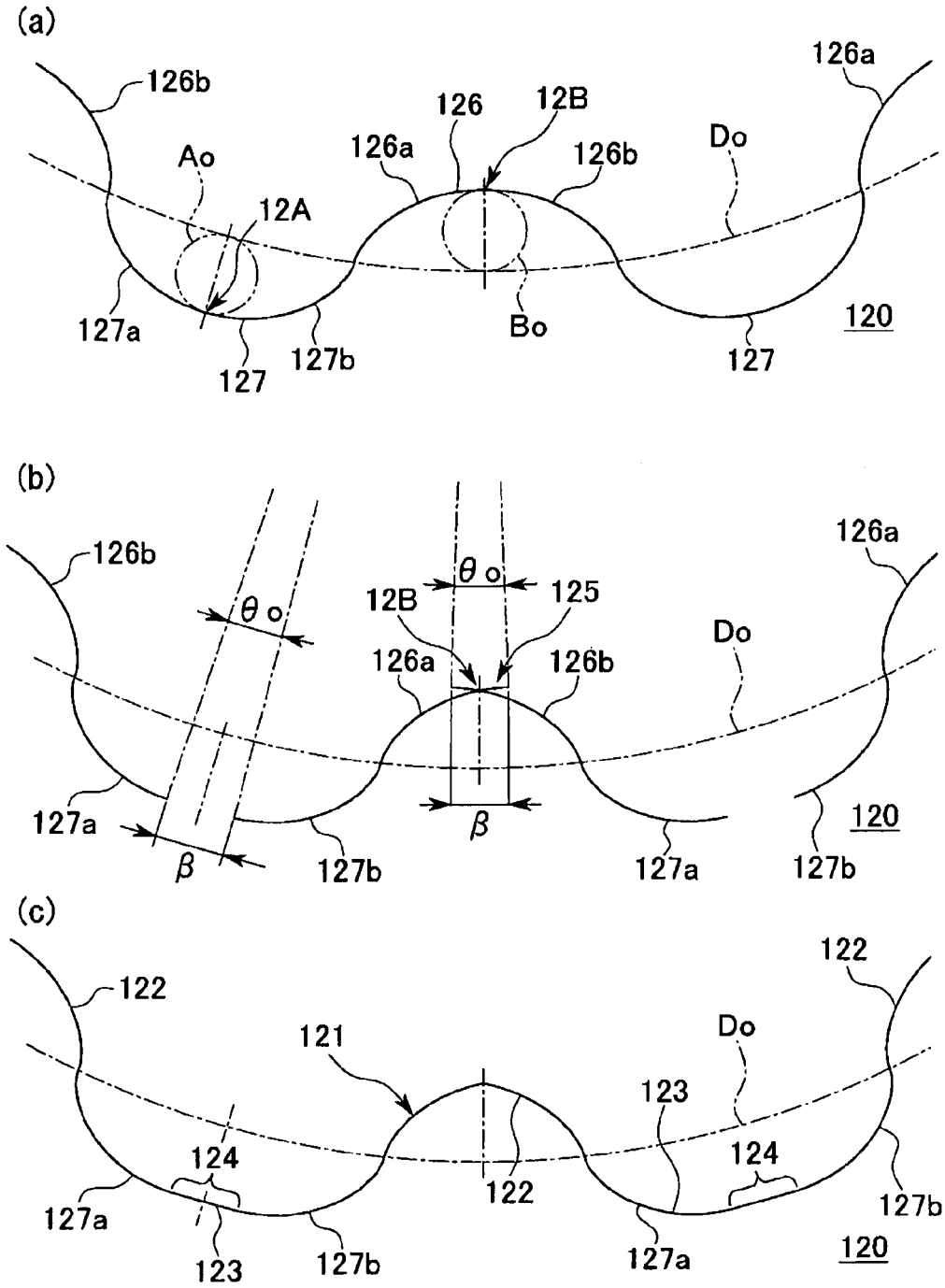
FIG. 3 is a partially enlarged view showing the tooth profiles of internal teeth of an outer rotor according to the first embodiment of the present invention.

Next, as shown in FIG. 3B, the internal tooth curve segments 127*a* and 127*b* are moved along the circumference of the base circle Do so that a distance "β" is ensured between the internal tooth curve segments 127*a* and 127*b*. At this time, an angle defined by two lines, which are drawn by connecting the center Oo of the base circle Do and the ends of the internal tooth curve segments 127*a* and 127*b*, is designated by θo. Here, it is preferable to move two external tooth curve segments 127*a* and 127*b* by equal distance along the circumference, respectively, in a direction away from each other.

As shown in FIG. 3C, the separated ends of the internal tooth curve segments 127*a* and 127*b* are connected to each other by a complementary line 124 consisting of a curved line or a straight line. The obtained continuous curve is used as the profile of the tooth space 123.

That is, the tooth space 123 is formed using a continuous curve that includes the internal tooth curve segments 127*a* and 127*b*, which are separated from each other, and the complementary line 124 connecting the internal tooth curve segment 127*a* with the internal tooth curve segment 127*b*.

As a result, the circumferential thickness of the tooth space 123 is greater than a tooth space which is formed just using the simple hypocycloid curve 127 by an amount corresponding to the angle θo defined by two lines, which are drawn by connecting the center Oo of the base circle Do and the ends of the complementary line 124. In this embodiment, the complementary line 124, which connects the internal tooth curve segment 127*a* with the internal tooth curve segment 127*b*, is a straight line; however, the complementary line 124 may be a curve.

The circumferential thickness of the tooth space 123 is made to be greater than that of a conventional tooth space as explained above, and on the other hand, in the outer rotor 120 of the present embodiment, the width of the tooth tip 122 is decreased, and tooth surface profiles are smoothly connected to each other over the entirety of the circumference.

In order to form the profile of the tooth tip 122, first, the hypocycloid curve 126 (FIG. 3A) generated by the inscribed-rolling circle Bo is equally divided at a midpoint 12B thereof into two segments that are designated by curve segments 126*a* and 126*b*, respectively.

Here, the midpoint 12B of the hypocycloid curve 126 is a point that symmetrically divides into two segments the hypocycloid curve 126 which is generated by rolling the inscribed-rolling circle Bo by one turn on the base circle Do of the outer rotor 120 without slippage. In other words, the midpoint 12B is a point that is reached by a specific point on the inscribed-rolling circle Bo which draws the hypocycloid curve 126 when the inscribed-rolling circle Bo rolls a half turn.

Next, as shown in FIG. 3B, the curve segments 126*a* and 126*b* are moved along the circumference of the base circle Do so that the ends of the curve segments 126*a* and 126*b* are respectively connected to the ends of the continuous curve that forms the tooth space 123. At this time, the curve segments 126*a* and 126*b* overlap each other while intersecting each other at the midpoint 12B, and an angle, which is defined by both ends of an overlap portion 125 and the center Oo of the base circle Do, equals θo. Here, it is preferable to move two curve segments 126*a* and 126*b* by equal distance along the circumference, respectively, in a direction toward each other.

As shown in FIG. 3C, the curve segments 126*a* and 126*b* are smoothly connected to each other so as to form a continuous curve that defines the tooth surface profile of the tooth tip 122.

As a result, the circumferential width of the tooth tip 122 is less than that of the profile of a tooth tip which is formed just using the simple hypocycloid curve 126 by an amount corresponding to the angle θo.

As explained above, in the case of the internal teeth 121 of the outer rotor 120, the circumferential thickness of the tooth tip 122 is made to be smaller and the circumferential width of the tooth space 123 is made to be greater when compared with the case in which tooth profiles are formed just using epicycloid curve 127 and the hypocycloid curve 126 that are generated by the circumscribed-rolling circle Ao and the inscribed-rolling circle Bo, respectively.

Further, the distance β between two internal tooth curve segments 127*a* and 127*b* of the outer rotor 120 is set so as to satisfy the following inequality $$0.01\ [\mathrm{mm}] \leqq \beta$$

As a result, a circumferential clearance between the tooth surfaces of the inner rotor 110 and the outer rotor 120 is appropriately ensured, so that the silence property of an oil pump rotor assembly can be sufficiently improved.

Further, the distance β between two internal tooth curve segments 127*a* and 127*b* of the outer rotor 120 is set so as to satisfy the following inequality:

$$\beta \leqq 0.08\ [\mathrm{mm}]$$

As a result, the clearance between the tooth faces between the inner rotor 110 and the outer rotor 120 can be prevented from being too small, and locking in rotation, increase in wear, and reduction in service life of the oil pump rotor assembly can be prevented.

In the inner rotor 110 and the outer rotor 120, because "α" and "β", i.e., the amounts of movement of the tooth curve segments are too small to be shown in linear scale, they are greatly enlarged in FIGS. 2A to 2C, and in FIGS. 3A to 3C in order to explain the detailed profiles of the tooth surfaces; therefore, the tooth profiles shown in FIGS. 2A to 2C, and in FIGS. 3A to 3C are distorted when compared with the actual tooth profiles shown in FIG. 1.

In the above embodiment, the circumferential thicknesses of both tooth space 113 of the inner rotor 110 and tooth space 123 of the outer rotor 120 are increased when compared with conventional cases; however, the present invention is not limited to this, and other configurations may be employed in which the tooth space 113 of the inner rotor 110 or tooth space 123 of the outer rotor 120 is made thicker, and the tooth profile of the other tooth space is formed using a cycloid curve without modification.

The detailed profile of each of the external teeth 211 of the inner rotor 210 and the detailed profile of each of the internal teeth 221 of the outer rotor 220 according to a second embodiment, which are formed based on the curves drawn by the base circles Di and Do, the epicycloid curves Ai and Ao, and the hypocycloid curves Bi and Bo that satisfy the above equations (1) to (6), will be explained with reference to FIGS. 4A to 4C, and FIGS. 5A to 5C.

The external teeth 211 of the inner rotor 210 are formed by alternately arranging tooth tips 212 and tooth spaces 213 in the circumferential direction.

In order to form the profile of the tooth space 213, first, the hypocycloid curve 217 (FIG. 4A) generated by the inscribed-rolling circle Bi is equally divided at a midpoint 21B thereof into two segments that are designated by curve segments 217*a* and 217*b*, respectively.

Figure 4:
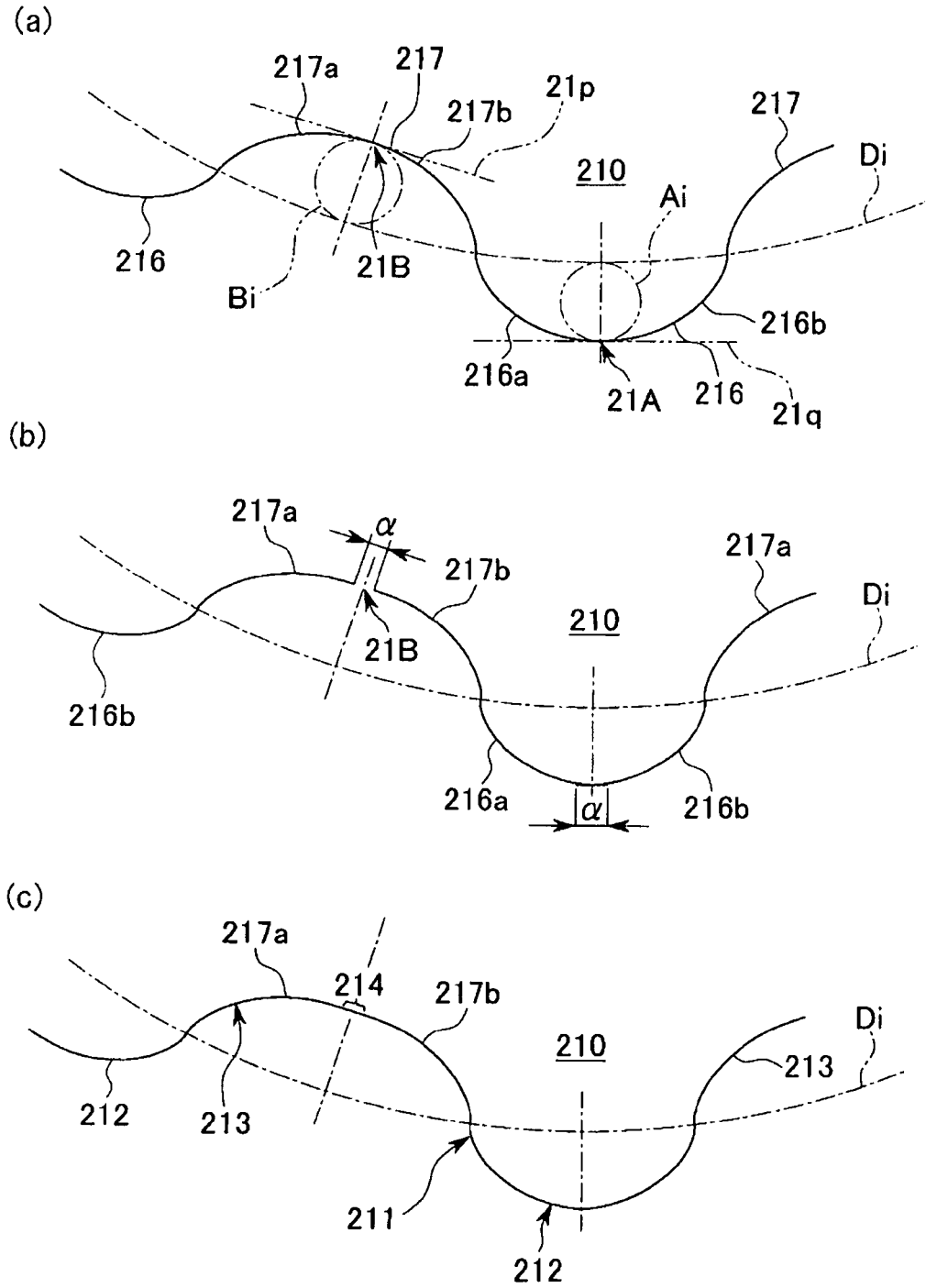
FIG. 4 is a partially enlarged view showing the profiles of external teeth of an inner rotor according to a second embodiment of the present invention.

Next, as shown in FIG. 4B, the external tooth curve segments 217*a* and 217*b* are moved along the tangential line 21*p* of the hypocycloid curve 217 drawn at the midpoint 21B so that a distance "α" is ensured between the external tooth curve segments 217*a* and 217*b*. Here, it is preferable to move two external tooth curve segments 217*a* and 217*b* by equal distance along the tangential line 21*p*, respectively, in a direction away from each other.

As shown in FIG. 4C, the separated ends of the external tooth curve segments 217*a* and 217*b* are connected to each other by a complementary line 214 consisting of a straight line. The obtained continuous curve is used as the profile of the tooth space 213.

That is, the tooth space 213 is formed using a continuous curve that includes the external tooth curve segments 217*a* and 217*b*, which are separated from each other, and the complementary line 214 connecting the, external tooth curve segment 217*a* with the external tooth curve segment 217*b*.

As a result, the circumferential thickness of the tooth space 213 of the inner rotor 210 is greater than a tooth space which is formed just using the simple hypocycloid curve 217 by an amount corresponding to the interposed complementary line 214. In this embodiment, the complementary line 214, which connects the external tooth curve segment 217*a* with the external tooth curve segment 217*b*, is a straight line; however, the complementary line 214 may be a curve.

The circumferential thickness of the tooth space 213 is made to be greater than that of a conventional tooth space as explained above, and on the other hand, in the inner rotor 110 of the present embodiment, the width of the tooth tip 212 is decreased, and tooth surface profiles are smoothly connected to each other over the entirety of the circumference.

In order to form the profile of the tooth tip 212, first, the epicycloid curve 216 (FIG. 4A) generated by the circumscribed-rolling circle Ai is equally divided at a midpoint 21A thereof into two segments that are designated by curve segments 216*a* and 216*b*, respectively.

Here, the midpoint 21A of the epicycloid curve 216 is a point that symmetrically divides into two segments the epicycloid curve 216 which is generated by rolling the circumscribed-rolling circle Ai by one turn on the base circle Di of the inner rotor 210 without slippage. In other words, the midpoint 21A is a point that is reached by a specific point on the circumscribed-rolling circle Ai which draws the epicycloid curve 216 when the circumscribed-rolling circle Ai rolls a half turn.

Next, as shown in FIG. 4B, the curve segments 216*a* and 216*b* are moved along a tangential line 21*q* of the epicycloid curve 216 drawn at the midpoint B2 thereof so that the ends of the curve segments 216*a* and 216*b* are respectively connected to the ends of the continuous curve that forms the tooth space 213. At this time, the curve segments 216*a* and 216*b* overlap each other while intersecting each other at the midpoint 21A. Here, it is preferable to move two curve segments 216*a* and 216*b* by equal distance along the tangential line 21*q*, respectively, in a direction toward each other.

As shown in FIG. 4C, the curve segments 216*a* and 216*b* are smoothly connected to each other so as to form a continuous curve that defines the tooth surface profile of the tooth tip 212.

As a result, the circumferential width of the tooth tip 212 is less than that of a tooth tip which is formed just using the simple epicycloid curve 216 by an amount corresponding to the complementary line 214 interposed in the tooth space 213.

As explained above, in the case of the external teeth 211 of the inner rotor 210, the circumferential thickness of the tooth tip 212 is made to be smaller and the circumferential width of the tooth space 213 is decreased when compared with the case in which tooth profiles are formed just using the epicycloid curve 216 and the hypocycloid curve 217 that are generated by the circumscribed-rolling circle Ai and the inscribed-rolling circle Bi, respectively.

Here, the distance α between two external tooth curve segments 217*a* and 217*b* of the inner rotor 210 is set so as to satisfy the following inequality:

$$0.01\ [\mathrm{mm}] \leqq \alpha$$

As a result, a circumferential clearance between the tooth surfaces of the inner rotor 210 and the outer rotor 220 is appropriately ensured, so that the silence property of an oil pump rotor assembly can be sufficiently improved.

Further, the distance ax between two external tooth curve segments 217*a* and 217*b* of the inner rotor 210 is set so as to satisfy the following inequality:

$$\alpha \leqq 0.08\ [\mathrm{mm}]$$

As a result, the clearance between the tooth faces between the inner rotor 210 and the outer rotor 220 can be prevented from being too small, and locking in rotation, increase in wear, and reduction in service life of the oil pump rotor assembly can be prevented.

Next, the detailed profile of each of the internal teeth 221 of the outer rotor 220 according to the present embodiment will be explained with reference to FIGS. 5A to 5C.

The internal teeth 221 of the outer rotor 220 are formed by alternately arranging tooth tips 222 and tooth spaces 223 in the circumferential direction.

In order to form the profile of the tooth space 223, first, the epicycloid curve 227 (FIG. 5A) generated by the circumscribed-rolling circle Ao is equally divided at a midpoint 22A thereof into two segments that are designated by curve segments 227*a* and 227*b*, respectively.

Here, the midpoint 22A of the epicycloid curve 227 is a point that symmetrically divides into two segments the epicycloid curve 227 which is generated by rolling the circumscribed-rolling circle Ao by one turn on the base circle Do of the outer rotor 220 without slippage. In other words, the midpoint 22A is a point that is reached by a specific point on the circumscribed-rolling circle Ao which draws the epicycloid curve 227 when the circumscribed-rolling circle Ao rolls a half turn.

Figure 5:
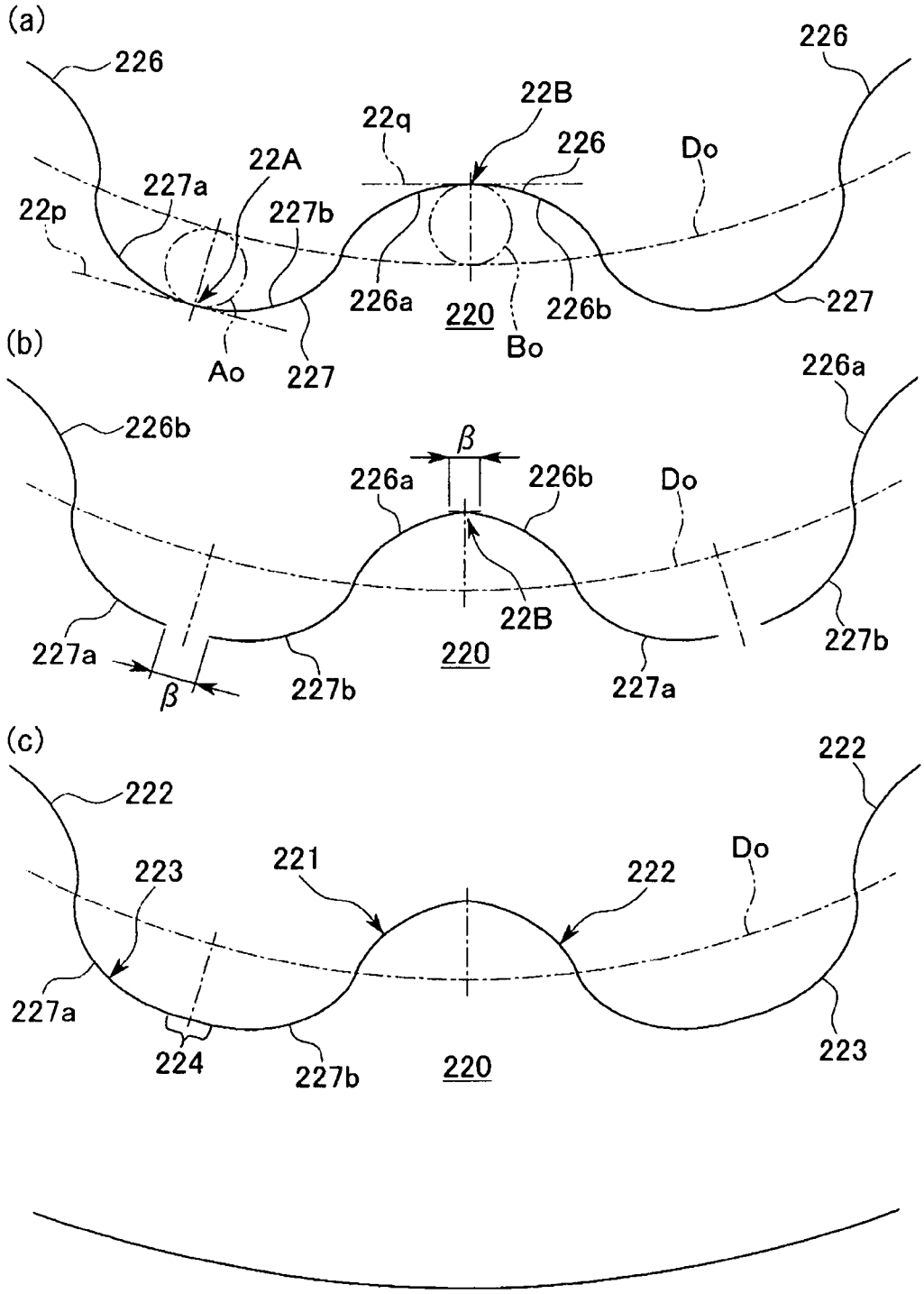
FIG. 5 is a partially enlarged view showing the profiles of internal teeth of an outer rotor according to the second embodiment of the present invention.

Next, as shown in FIG. 5B, the internal tooth curve segments 227*a* and 227*b* are moved along the tangential line 22*p* of the epicycloid curve 227 drawn at the midpoint 22A so that a distance "β" is ensured between the internal tooth curve segments 227*a* and 227*b*. Here, it is preferable to move two internal tooth curve segments 227*a* and 227*b* by equal distance along the tangential line 22*p*, respectively, in a direction away from each other.

As shown in FIG. 5C, the separated ends of the internal tooth curve segments 227*a* and 227*b* are connected to each other by a complementary line 224 consisting of a straight line. The obtained continuous curve is used as the profile of the tooth space 223.

That is, the tooth space 223 is formed using a continuous curve that includes the internal tooth curve segments 227*a* and 227*b*, which are separated from each other, and the complementary line 224 connecting the internal tooth curve segment 227*a* with the internal tooth curve segment 227*b*.

As a result, the circumferential thickness of the tooth space 223 is greater than a tooth space which is formed just using the simple epicycloid curve 227 by an amount corresponding to the interposed complementary line 224.

In this embodiment, the complementary line 224, which connects the internal tooth curve segment 227*a* with the internal tooth curve segment 227*b*, is a straight line; however, the complementary line 224 may be a curve.

The circumferential thickness of the tooth space 223 is made to be greater than that of a conventional tooth space as explained above, and on the other hand, in the outer rotor 220 of the present embodiment, the width of the tooth tip 222 is decreased, and tooth surface profiles are smoothly connected to each other over the entirety of the circumference.

In order to form the profile of the tooth tip 222, first, the hypocycloid curve 226 (FIG. 5A) generated by the inscribed-rolling circle Bo is equally divided at a midpoint 22B thereof into two segments that are designated by curve segments 226*a* and 226*b*, respectively.

Here, the midpoint 22B of the hypocycloid curve 226 is a point that symmetrically divides into two segments the hypocycloid curve 226 which is generated by rolling the inscribed-rolling circle Bo by one turn on the base circle Do of the outer rotor 220 without slippage. In other words, the midpoint 22B is a point that is reached by a specific point on the inscribed-rolling circle Bo which draws the hypocycloid curve 226 when the inscribed-rolling circle Bo rolls a half turn.

Next, as shown in FIG. 5B, the curve segments 226*a* and 226*b* are moved along a tangential line 22*q* at the midpoint 22B so that the ends of the curve segments 226*a* and 226*b* are respectively connected to the ends of the continuous curve that forms the tooth space 223, and the curve segments 226*a* and 226*b* overlap each other while intersecting each other at the midpoint 22B. Here, it is preferable to move two curve segments 226*a* and 226*b* by equal distance along the tangential line 22*q*, respectively, in a direction toward each other.

As shown in FIG. 5C, the curve segments 226*a* and 226*b* are smoothly connected to each other so as to form a continuous curve that defines the tooth surface profile of the tooth tip 222.

As a result, the circumferential width of the tooth tip 222 is less than that of a tooth space which is formed just using the simple hypocycloid curve 226 by an amount corresponding to the complementary line 224 interposed in the tooth space 223.

As explained above, in the case of the internal teeth 221 of the outer rotor 220, the circumferential thickness of the tooth tip 222 is made to be smaller and the circumferential width of the tooth space 223 is increased when compared with the case in which tooth profiles are formed just using the epicycloid curve 227 and the hypocycloid curve 226 that are generated by the circumscribed-rolling circle Ao and the inscribed-rolling circle Bo, respectively.

Further, the distance β between two internal tooth curve segments 227*a* and 227*b* of the outer rotor 220 is set so as to satisfy the following inequality:

$$0.01\ [\mathrm{mm}] \leqq \beta$$

As a result, a circumferential clearance between the tooth surfaces of the inner rotor 210 and the outer rotor 220 is appropriately ensured, so that the silence property of an oil pump rotor assembly can be sufficiently improved.

Further, the distance β between two internal tooth curve segments 227*a* and 227*b* of the outer rotor 220 is set so as to satisfy the following inequality:

$$\beta \leqq 0.08\ [\mathrm{mm}]$$

As a result, the clearance between the tooth faces between the inner rotor 110 and the outer rotor 120 can be prevented from being too small, and locking in rotation, increase in wear, and reduction in service life of the oil pump rotor assembly can be prevented.

In the above embodiment, the circumferential thicknesses of both tooth space 213 of the inner rotor 210 and tooth space 223 of the outer rotor 220 are increased when compared with conventional cases; however, the present invention is not limited to this, and other configurations may be employed in which the tooth space 213 of the inner rotor 210 or tooth space 223 of the outer rotor 220 is made thicker, and the tooth profile of the other tooth space is formed using a cycloid curve without modification.

In the inner and outer rotors 210 and 220, because "α" and "β", i.e., the amounts of movement of the tooth curve segments are too small to be shown in linear scale, they are greatly enlarged in FIGS. 4A to 4C, and in FIGS. 5A to 5C in order to explain the detailed profiles of the tooth surfaces; therefore, the tooth profiles shown in FIGS. 4A to 4C, and in FIGS. 5A to 5C are distorted when compared with the actual tooth profiles.

Next, the detailed profile of each of the external teeth 311 of the inner rotor 310 and the detailed profile of each of the internal teeth 321 of the outer rotor 320 according to a third embodiment, which are formed based on the curves drawn by the base circles Di and Do, the epicycloid curves Ai and Ao, and the hypocycloid curves Bi and Bo that satisfy the above equations (1) to (6), will be explained with reference to FIGS. 6A to 6D, and FIGS. 7A to 7D.

The external teeth 311 of the inner rotor 310 are formed by alternately arranging tooth tips 312 and tooth spaces 313 in the circumferential direction.

In order to form the profile of the tooth space 313, first, the hypocycloid curve 317 (FIG. 6A) generated by the inscribed-rolling circle Bi is equally divided at a midpoint 31B thereof into two segments that are designated by curve segments 317*a* and 317*b*, respectively.

Here, the midpoint 31B of the hypocycloid curve 317 is a point that symmetrically divides into two segments the hypocycloid curve 317 which is generated by rolling the inscribed-rolling circle Bi by one turn on the base circle Di of the inner rotor 310 without slippage. In other words, the midpoint 31B is a point that is reached by a specific point on the inscribed-rolling circle Bi which draws the hypocycloid curve 317 when the inscribed-rolling circle Bi rolls a half turn.

Figure 6:
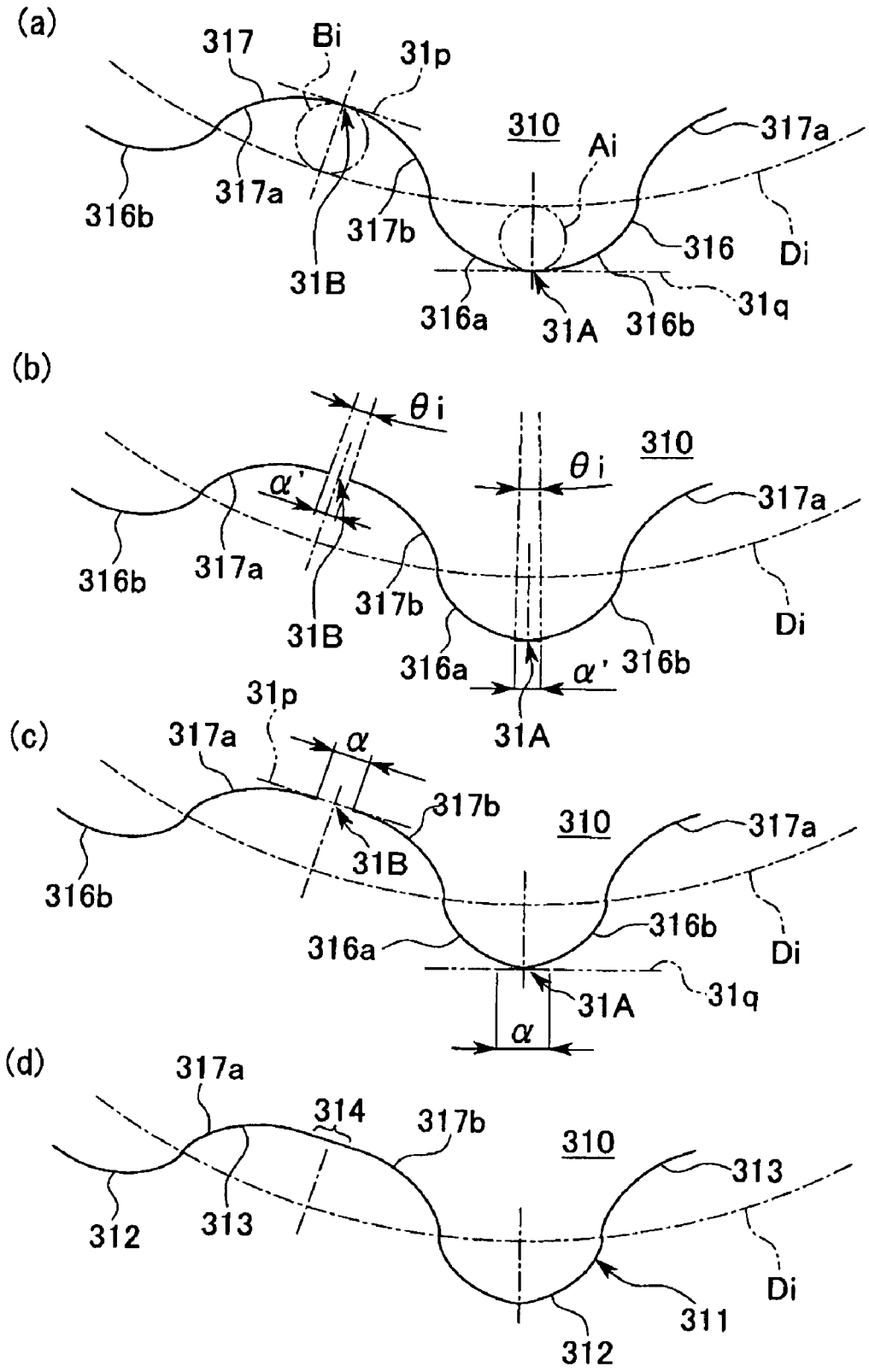
FIG. 6 is a partially enlarged view showing the profiles of external teeth of an inner rotor according to a third embodiment of the present invention.

Next, as shown in FIG. 6B, the external tooth curve segments 317*a* and 317*b* are moved about the center Oi and along the circumference of the base circle Di by an amount of angle θi so that a distance "α" is ensured between the external tooth curve segments 317*a* and 317*b*. At this time, an angle defined by two lines, which are drawn by connecting the center Oi of the base circle Di and the ends of the external tooth curve segments 317*a* and 317*b*, is designated by θi. Here, it is preferable to move two external tooth curve segments 317*a* and 317*b* by equal distance along the circumference, respectively, in a direction away from each other.

Next, as shown in FIG. 6C, the external tooth curve segments 317*a* and 317*b* are moved along the tangential line 31*p* of the hypocycloid curve 317 drawn at the midpoint 31B so that a distance "α"t is ensured between the external tooth curve segments 317*a* and 317*b*. Here, it is preferable to move two external tooth curve segments 317*a* and 317*b* by equal distance along the tangential line 31*p*, respectively, in a direction away from each other.

As shown in FIG. 6D, the separated ends of the external tooth curve segments 317*a* and 317*b* are connected to each other by a complementary line 314 consisting of a straight line. The obtained continuous curve is used as the profile of the tooth space 313.

That is, the tooth space 313 is formed using a continuous curve that includes the external tooth curve segments 317*a* and 317*b*, which are separated from each other, and the complementary line 314 connecting the external tooth curve segment 317*a* with the external tooth curve segment 317*b*.

As a result, the circumferential thickness of the tooth space 313 of the inner rotor 310 is greater than a tooth space which is formed just using the simple hypocycloid curve 317 by an amount corresponding to the interposed complementary line 314. In this embodiment, the complementary line 314, which connects the external tooth curve segment 317*a* with the external tooth curve segment 317*b*, is a straight line; however, the complementary line 314 may be a curve.

The circumferential thickness of the tooth space 313 is made to be greater than that of a conventional tooth tip as explained above, and on the other hand, in this embodiment, the width of the tooth tip 312 is decreased, and tooth profiles are smoothly connected to each other over the entirety of the circumference.

In order to form the profile of the tooth tip 312, first, the epicycloid curve 316 (FIG. 6A) generated by the circumscribed-rolling circle Ai is equally divided at a midpoint 31A thereof into two segments that are designated by curve segments 316*a* and 316*b*, respectively.

Here, the midpoint 31A of the epicycloid curve 316 is a point that symmetrically divides into two segments the epicycloid curve 316 which is generated by rolling the circumscribed-rolling circle Ai by one turn on the base circle Di of the inner rotor 310 without slippage. In other words, the midpoint 31A is a point that is reached by a specific point on the circumscribed-rolling circle Ai which draws the epicycloid curve 316 when the circumscribed-rolling circle Ai rolls a half turn.

Next, as shown in FIG. 6B, the curve segments 316*a* and 316*b* are moved along the circumference of the base circle Di so that the ends of the curve segments 316*a* and 316*b* are respectively connected to the ends of the moved external tooth curve segments 317*a*, 317*b*. As a result, the curve segments 316*a* and 316*b* overlap each other while intersecting each other at the midpoint 31A. Here, it is preferable to move two curve segments 316*a* and 316*b* by equal distance along the circumference, respectively, in a direction toward each other.

Next, as shown in FIG. 6C, the curve segments 316*a* and 316*b* are moved along a tangential line 31*q* of the epicycloid curve 316 drawn at the midpoint 31A thereof so that the ends of the curve segments 316*a* and 316*b* are respectively connected to the ends of the continuous curve that forms the tooth space 313. Here, it is preferable to move two curve segments 316*a* and 316*b* by equal distance along the tangential line 31*q*, respectively, in a direction toward each other.

As shown in FIG. 6D, the curve segments 316*a* and 316*b* are smoothly connected to each other so as to form a continuous curve that defines the tooth surface profile of the tooth tip 312.

As a result, the circumferential width of the tooth tip 312 is less than that of a tooth tip which is formed just using the simple epicycloid curve 316 by an amount corresponding to the complementary line 314 interposed in the tooth space 313.

As explained above, in the case of the external teeth 311 of the inner rotor 310, the circumferential thickness of the tooth tip 312 is made to be smaller and the circumferential width of the tooth space 313 is increased when compared with the case in which tooth profiles are formed just using the epicycloid curve 316 and the hypocycloid curve 317 that are generated by the circumscribed-rolling circle Ai and the inscribed-rolling circle Bi, respectively.

Here, the distance α between two external tooth curve segments 317*a* and 317*b* of the inner rotor 310 is set so as to satisfy the following inequality:

$$0.01\ [\mathrm{mm}] \leqq \alpha$$

As a result, a circumferential clearance between the tooth surfaces of the inner rotor 310 and the outer rotor 320 is appropriately ensured, so that the silence property of an oil pump rotor assembly can be sufficiently improved.

Further, the distance a between two external tooth curve segments 317*a* and 317*b* of the inner rotor 310 is set so as to satisfy the following inequality:

$$\alpha \leqq 0.08\ [\mathrm{mm}]$$

As a result, the clearance between the tooth faces between the inner rotor 310 and the outer rotor 320 can be prevented from being too small, and locking in rotation, increase in wear, and reduction in service life of the oil pump rotor assembly can be prevented.

Next, the detailed profile of each of the internal teeth 321 of the outer rotor 320 according to the present embodiment will be explained with reference to FIGS. 7A to 7D.

The internal teeth 321 of the outer rotor 320 are formed by alternately arranging tooth tips 322 and tooth spaces 323 in the circumferential direction of the base circle Do.

In order to form the profile of the tooth space 323, first, the epicycloid curve 327 (FIG. 7A) generated by the circumscribed-rolling circle Ao is equally divided at a midpoint 32A thereof into two segments that are designated by curve segments 327*a* and 327*b*, respectively.

Here, the midpoint 32A of the epicycloid curve 327 is a point that symmetrically divides into two segments the epicycloid curve 327 which is generated by rolling the circumscribed-rolling circle Ao by one turn on the base circle Do of the outer rotor 320 without slippage. In other words, the midpoint 32A is a point that is reached by a specific point on the circumscribed-rolling circle Ao which draws the epicycloid curve 327 when the circumscribed-rolling circle Ao rolls a half turn.

Figure 7:
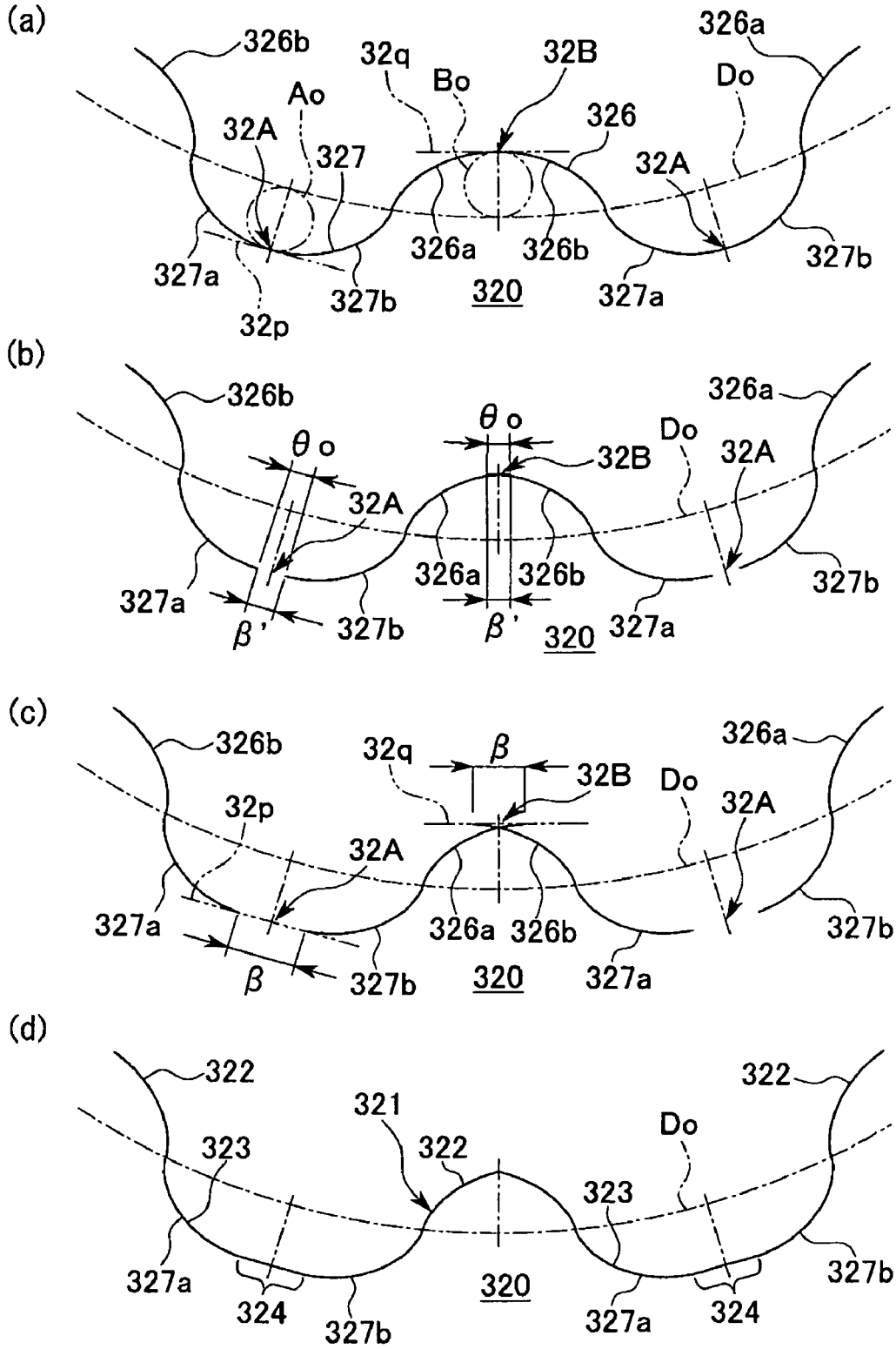
FIG. 7 is a partially enlarged view showing the profiles of internal teeth of an outer rotor according to the third embodiment of the present invention.

Next, as shown in FIG. 7B, the internal tooth curve segments 327*a* and 327*b* are moved along the circumference of the base circle Do by an amount of angle θo so that a distance "β" is ensured between the internal tooth curve segments 327*a* and 327*b*. Here, it is preferable to move two internal tooth curve segments 327*a* and 327*b* by equal distance along the circumference, respectively, in a direction away from each other.

Moreover, as shown in FIG. 7C, the external tooth curve segments 327*a* and 327*b* are moved along the tangential line 32*p* of the epicycloid curve 327 drawn at the midpoint 32A so that a distance "β" is ensured between the external tooth curve segments 327*a* and 327*b*. Here, it is preferable to move two internal tooth curve segments 327*a* and 327*b* by equal distance along the tangential line 32*p*, respectively, in a direction away from each other.

As shown in FIG. 7D, the separated ends of the internal tooth curve segments 327*a* and 327*b* are connected to each other by a complementary line 324 consisting of a straight line. The obtained continuous curve is used as the profile of the tooth space 323.

That is, the tooth space 323 is formed using a continuous curve that includes the internal tooth curve segments 327*a* and 327*b*, which are separated from each other, and the complementary line 324 connecting the internal tooth curve segment 327*a* with the internal tooth curve segment 327*b*.

As a result, the circumferential thickness of the tooth space 323 is greater than a tooth space which is formed just using the simple epicycloid curve 327 by an amount corresponding to the interposed complementary line 324. In this embodiment, the complementary line 324, which connects the internal tooth curve segment 327*a* with the internal tooth curve segment 327*b*, is a straight line; however, the complementary line 324 may be a curve.

The circumferential thickness of the tooth space 313 is made to be greater than that of a conventional tooth tip as explained above, and on the other hand, in this embodiment, the width of the tooth tip 312 is decreased, and tooth profiles are smoothly connected to each other over the entirety of the circumference.

In order to form the profile of the tooth tip 322, first, the hypocycloid curve 326 (FIG. 7A) generated by the inscribed-rolling circle Bo is equally divided at a midpoint 32B thereof into two segments that are designated by curve segments 326*a* and 326*b*, respectively.

Here, the midpoint 32B of the hypocycloid curve 326 is a point that symmetrically divides into two segments the hypocycloid curve 326 which is generated by rolling the inscribed-rolling circle Bo by one turn on the base circle Do of the outer rotor 320 without slippage. In other words, the midpoint 32B is a point that is reached by a specific point on the inscribed-rolling circle Bo which draws the hypocycloid curve 326 when the inscribed-rolling circle Bo rolls a half turn.

Next, as shown in FIG. 7B, the curve segments 326*a* and 326*b* are moved along the circumference of the base circle Do so that the ends of the curve segments 326*a* and 326*b* are respectively connected to the ends of the moved internal tooth curve segments 327*a* and 327*b*. As a result, the curve segments 326*a* and 326*b* overlap each other while intersecting each other at the midpoint 32B. Here, it is preferable to move two curve segments 326*a* and 326*b* by equal distance along the circumference, respectively, in a direction toward each other.

Next, as shown in FIG. 7C, the curve segments 326*a* and 326*b* are moved along a tangential line 32*q* of the hypocycloid curve 326 drawn at the midpoint 32B thereof so that the ends of the curve segments 326*a* and 326*b* are respectively connected to the ends of the continuous curve that forms the tooth space 323. Here, it is preferable to move two curve segments 326*a* and 326*b* by equal distance along the tangential line 32*q*, respectively, in a direction toward each other.

As shown in FIG. 7D, the curve segments 326*a* and 326*b* are smoothly connected to each other so as to form a continuous curve that defines the tooth profile of the tooth tip 322.

As a result, the circumferential width of the tooth tip 322 is less than that of a tooth tip which is formed just using the simple hypocycloid curve 326 by an amount corresponding to the complementary line 324 interposed in the tooth space 323.

As explained above, in the case of the internal teeth 321 of the outer rotor 320, the circumferential thickness of the tooth tip 322 is made to be smaller and the circumferential width of the tooth space 323 is increased when compared with the case in which tooth profiles are formed just using the epicycloid curve 327 and the hypocycloid curve 326 that are generated by the circumscribed-rolling circle Ao and the inscribed-rolling circle Bo, respectively.

Further, the distance β between two internal tooth curve segments 327*a* and 327*b* of the outer rotor 320 is set so as to satisfy the following inequality:

$$0.01\ [\mathrm{mm}] \leqq \beta$$

As a result, a circumferential clearance between the tooth surfaces of the inner rotor 310 and the outer rotor 320 is appropriately ensured, so that the silence property of an oil pump rotor assembly can be sufficiently improved.

Further, the distance β between two internal tooth curve segments 327*a* and 327*b* of the outer rotor 320 is set so as to satisfy the following inequality $$\beta \leqq 0.08\ [\mathrm{mm}]$$

As a result, the clearance between the tooth faces between the inner rotor 310 and the outer rotor 320 can be prevented from being too small, and locking in rotation, increase in wear, and reduction in service life of the oil pump rotor assembly can be prevented.

In the above embodiment, the circumferential thicknesses of both tooth space 313 of the inner rotor 310 and tooth space 323 of the outer rotor 320 are increased when compared with conventional cases; however, the present invention is not limited to this, and other configurations may be employed in which one of the tooth space 313 of the inner rotor 310 and tooth space 323 of the outer rotor 320 is made thicker, and the tooth profile of the other tooth tip is formed using a cycloid curve without modification.

In the inner and outer rotors 310 and 320, because "α" and "β", i.e., the amounts of movement of the tooth curve segments are too small to be shown in linear scale, they are greatly enlarged in FIGS. 6A to 6D, and in FIGS. 7A to 7D in order to explain the detailed profiles of the tooth surfaces; therefore, the tooth profiles shown in FIGS. 6A to 6D, and in FIGS. 7A to 7D are distorted when compared with the actual tooth profiles.

Next, the detailed profile of each of the external teeth 411 of the inner rotor 410 and the detailed profile of each of the internal teeth 421 of the outer rotor 420 according to a fourth embodiment, which are formed based on the curves drawn by the base circles Di and Do, the epicycloid curves Ai and Ao, and the hypocycloid curves Bi and Bo that satisfy the above equations (1) to (6), will be explained with reference to FIGS. 8A to 8D, and FIGS. 9A to 9D.

The external teeth 411 of the inner rotor 410 are formed by alternately arranging tooth tips 412 and tooth spaces 413 in the circumferential direction.

In order to form the profile of the tooth space 413, first, the hypocycloid curve 417 (FIG. 8A) generated by the inscribed-rolling circle Bi is equally divided at a midpoint 41B thereof into two segments that are designated by curve segments 417*a* and 417*b*, respectively.

Here, the midpoint 41B of the hypocycloid curve 417 is a point that symmetrically divides into two segments the hypocycloid curve 417 which is generated by rolling the inscribed-rolling circle Bi by one turn on the base circle Di of the inner rotor 410 without slippage. In other words, the midpoint 41B is a point that is reached by a specific point on the inscribed-rolling circle Bi which draws the hypocycloid curve 417 when the inscribed-rolling circle Bi rolls a half turn.

Figure 8:
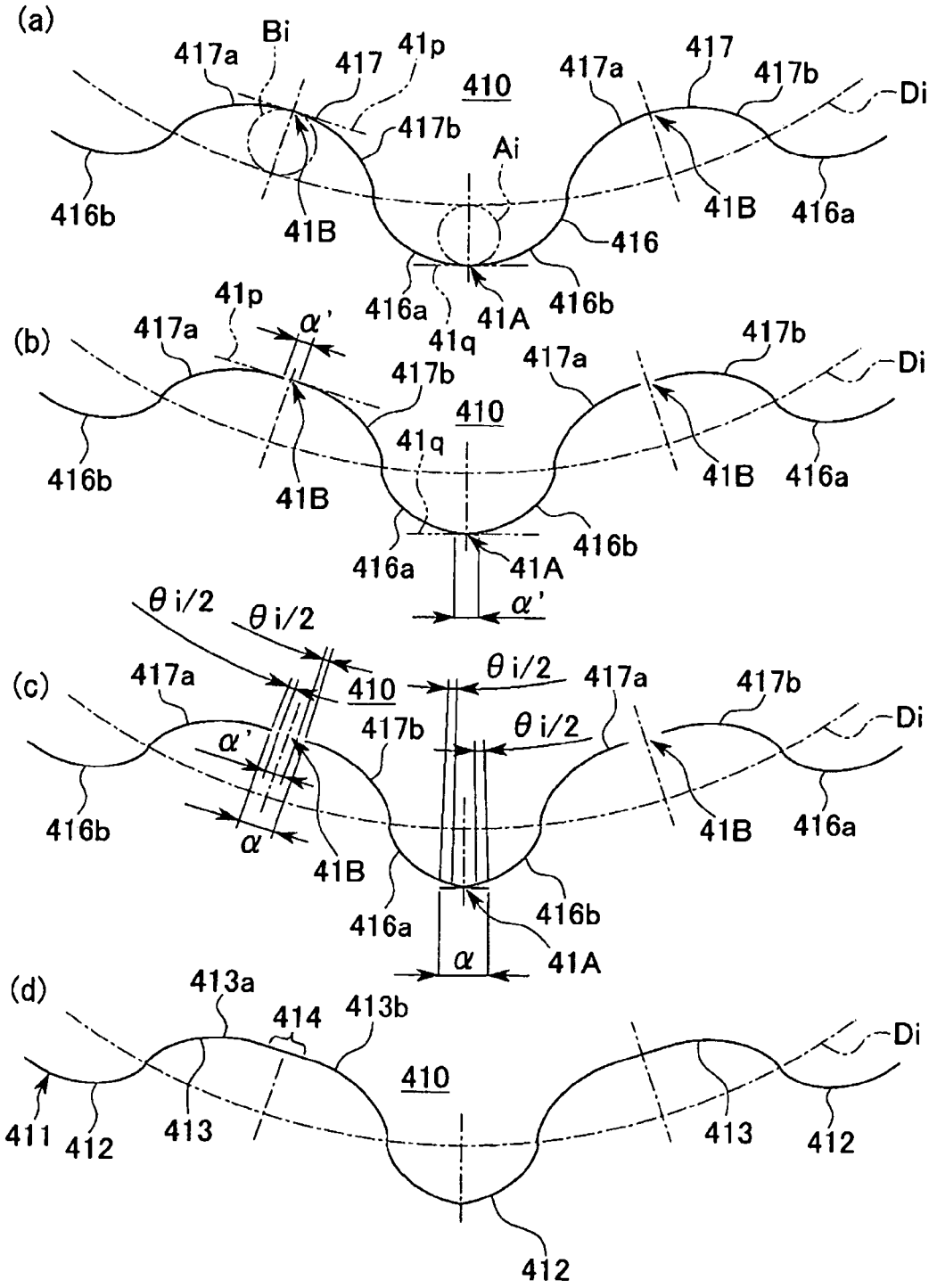
FIG. 8 is a partially enlarged view showing the profiles of external teeth of an inner rotor according to a fourth embodiment of the present invention.

Next, as shown in FIG. 8B, the external tooth curve segments 417*a* and 417*b* are moved along the tangential line 41*p* of the hypocycloid curve 417 drawn at the midpoint 41B so that a distance "α" is ensured between the external tooth curve segments 417*a* and 417*b*. Here, it is preferable to move two external tooth curve segments 417*a* and 417*b* by equal distance along the tangential line 41*p*, respectively, in a direction away from each other.

Moreover, as shown in FIG. 8C, the external tooth curve segments 417*a* and 417*b* are moved about the center Oi and along the circumference of the base circle Di by an amount of angle θi/2 so that a distance "α" is ensured between the external tooth curve segments 417*a* and 417*b*.

As shown in FIG. 8D, the separated ends of the external tooth curve segments 417*a* and 417*b* are connected to each other by a complementary line 414 consisting of a straight line. The obtained continuous curve is used as the profile of the tooth space 413.

That is, the tooth space 413 is formed using a continuous curve that includes the external tooth curve segments 417*a* and 417*b*, which are separated from each other, and the complementary line 414 connecting the external tooth curve segment 417*a* with the external tooth curve segment 417*b*.

As a result, the circumferential thickness of the tooth space 413 of the inner rotor 410 is greater than a tooth tip which is formed just using the simple hypocycloid curve 417 by an amount corresponding to the interposed complementary line 414. In this embodiment, the complementary line 414, which connects the external tooth curve segment 417*a* with the external tooth curve segment 417*b*, is a straight line; however, the complementary line 414 may be a curve.

The circumferential thickness of the tooth space 413 is made to be greater than that of a conventional tooth space as explained above, and on the other hand, in this embodiment, the width of the tooth tip 412 is decreased, and tooth profiles are smoothly connected to each other over the entirety of the circumference.

In order to form the profile of the tooth tip 412, first, the epicycloid curve 416 (FIG. 8A) generated by the circumscribed-rolling circle Ai is equally divided at a midpoint 41A thereof into two segments that are designated by curve segments 416*a* and 416*b*, respectively.

Here, the midpoint 41A of the epicycloid curve 416 is a point that symmetrically divides into two segments the epicycloid curve 416 which is generated by rolling the circumscribed-rolling circle Ai by one turn on the base circle Di of the inner rotor 410 without slippage. In other words, the midpoint 41A is a point that is reached by a specific point on the circumscribed-rolling circle Ai which draws the epicycloid curve 416 when the circumscribed-rolling circle Ai rolls a half turn.

Next, as shown in FIG. 8B, the curve segments 416*a* and 416*b* are moved along a tangential line 41*q* of the hypocycloid curve 416 drawn at the midpoint 41A thereof so that the ends of the curve segments 416*a* and 416*b* are respectively connected to the ends of the moved external tooth curve segments 417*a* and 417*b*. As a result, the curve segments 416*a* and 416*b* overlap each other while intersecting each other at the midpoint 41A. Here, it is preferable to move two curve segments 416*a* and 416*b* by equal distance along the tangential line 41*q*, respectively, in a direction toward each other.

Next, as shown in FIG. 8C, the curve segments 416*a* and 416*b* are moved along the circumference of the base circle Di so that the ends of the curve segments 416*a* and 416*b* are respectively connected to the ends of the continuous curve that forms the tooth space 413. Here, it is preferable to move two curve segments 416*a* and 416*b* by equal distance along the circumference, respectively, in a direction toward each other.

As shown in FIG. 8D, the curve segments 416*a* and 416*b* are smoothly connected to each other so as to form a continuous curve that defines the tooth surface profile of the tooth tip 412.

As a result, the circumferential width of the tooth tip 412 is less than that of a tooth tip which is formed just using the simple epicycloid curve 416 by an amount corresponding to the complementary line 414 interposed in the tooth space 413.

As explained above, in the case of the external teeth 411 of the inner rotor 410, the circumferential thickness of the tooth tip 412 is made to be smaller and the circumferential width of the tooth space 413 is increased when compared with the case in which tooth profiles are formed just using the epicycloid curve 416 and the hypocycloid curve 417 that are generated by the circumscribed-rolling circle Ai and the inscribed-rolling circle Bi, respectively.

Here, the distance a between two external tooth curve segments 417*a* and 417*b* of the inner rotor 410 is set so as to satisfy the following inequality:

$$0.01\ [\mathrm{mm}] \leqq \alpha$$

As a result, a circumferential clearance between the tooth surfaces of the inner rotor 410 and the outer rotor 420 is appropriately ensured, so that the silence property of an oil pump rotor assembly can be sufficiently improved.

Further, the distance a between two external tooth curve segments 417*a* and 417*b* of the inner rotor 410 is set so as to satisfy the following inequality:

$$\alpha \leqq 0.08\ [\mathrm{mm}]$$

As a result, the clearance between the tooth faces between the inner rotor 410 and the outer rotor 420 can be prevented from being too small, and locking in rotation, increase in wear, and reduction in service life of the oil pump rotor assembly can be prevented.

Next, the detailed profile of each of the internal teeth 421 of the outer rotor 420 according to the present embodiment will be explained with reference to FIGS. 9A to 9D.

The internal teeth 421 of the outer rotor 420 are formed by alternately arranging tooth tips 422 and tooth spaces 423 in the circumferential direction of the base circle Do.

In order to form the profile of the tooth space 423, first, the epicycloid curve 427 (FIG. 9A) generated by the circumscribed-rolling circle Ao is equally divided at a midpoint 42A thereof into two segments that are designated by curve segments 427*a* and 427*b*, respectively.

Here, the midpoint 42A of the epicycloid curve 427 is a point that symmetrically divides into two segments the epicycloid curve 427 which is generated by rolling the circumscribed-rolling circle Ao by one turn on the base circle Do of the outer rotor 420 without slippage. In other words, the midpoint 42A is a point that is reached by a specific point on the circumscribed-rolling circle Ao which draws the epicycloid curve 427 when the circumscribed-rolling circle Ao rolls a half turn.

Figure 9:
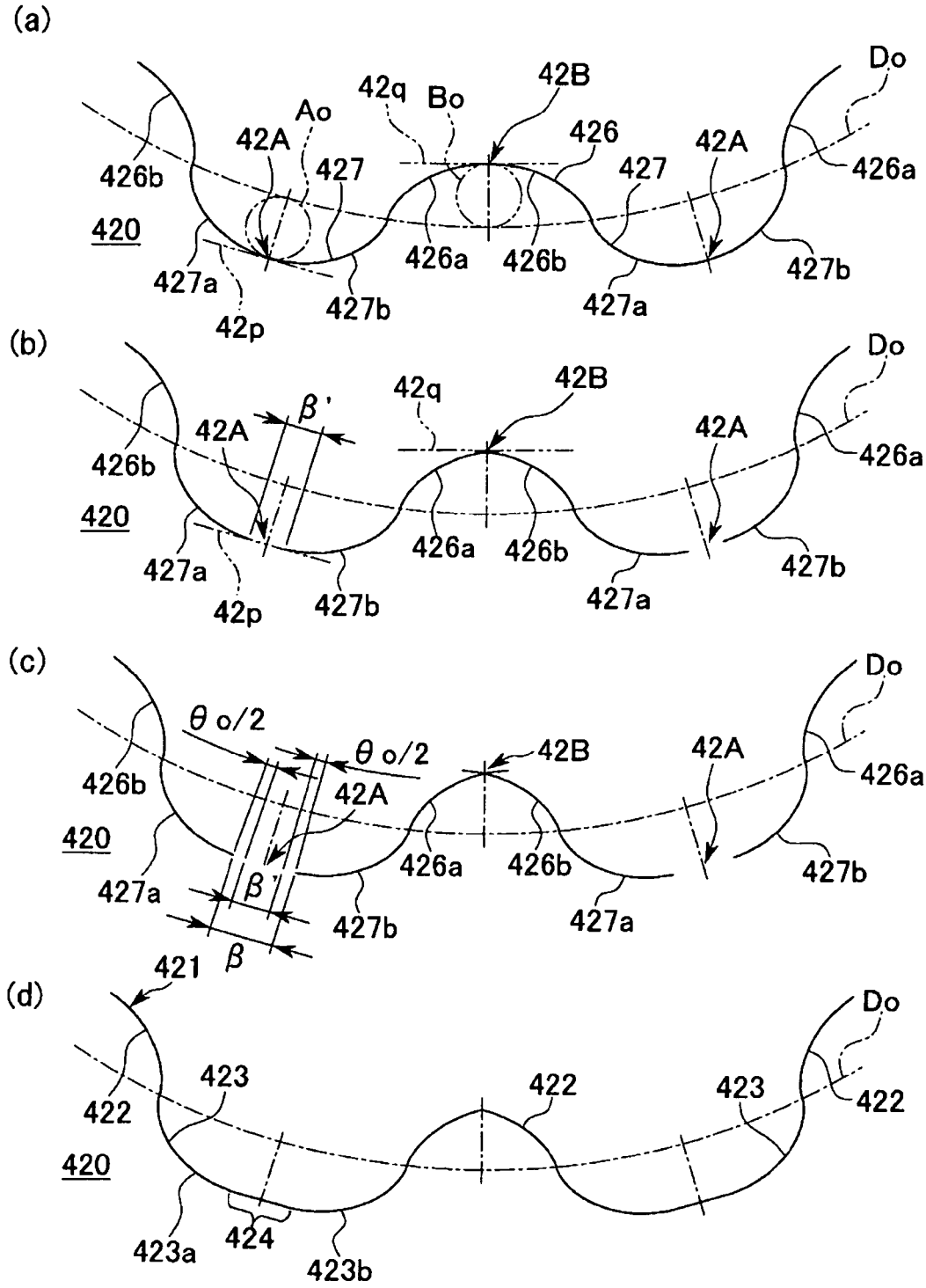
FIG. 9 is a partially enlarged view showing the profiles of internal teeth of an outer rotor according to the fourth embodiment of the present invention.

Next, as shown in FIG. 9B, the internal tooth curve segments 427*a* and 427*b* are moved along the tangential line 42*p* of the epicycloid curve 427 drawn at the midpoint 42A and so that a distance "β'" is ensured between the internal tooth curve segments 427*a* and 427*b*. Here, it is preferable to move two internal tooth curve segments 427*a* and 427*b* by equal distance along the tangential line 42*p*, respectively, in a direction away from each other.

Moreover, as shown in FIG. 9C, the internal tooth curve segments 427*a* and 427*b* are moved about the center Oo and along the circumference of the base circle Do by an amount of angle θo/2 so that a distance "β" is ensured between the internal tooth curve segments 427*a* and 427*b*.

As shown in FIG. 9D, the separated ends of the internal tooth curve segments 427*a* and 427*b* are connected to each other by a complementary line 424 consisting of a straight line. The obtained continuous curve is used as the profile of the tooth space 423.

That is, the tooth space 423 is formed using a continuous curve that includes the internal tooth curve segments 427*a* and 427*b*, which are separated from each other, and the complementary line 424 connecting the internal tooth curve segment 427*a* with the internal tooth curve segment 427*b*.

As a result, the circumferential thickness of the tooth space 423 is greater than a tooth space which is formed just using the simple epicycloid curve 427 by an amount corresponding to the interposed complementary line 424. In this embodiment, the complementary line 424, which connects the internal tooth curve segment 427*a* with the internal tooth curve segment 427*b*, is a straight line; however, the complementary line 424 may be a curve.

The circumferential thickness of the tooth space 423 is made to be greater than that of a conventional tooth space as explained above, and on the other hand, in this embodiment, the width of the tooth tip 422 is decreased, and tooth profiles are smoothly connected to each other over the entirety of the circumference.

In order to form the profile of the tooth tip 422, first, the hypocycloid curve 426 (FIG. 9A) generated by the inscribed-rolling circle Bo is equally divided at a midpoint 42B thereof into two segments that are designated by curve segments 426*a* and 426*b*, respectively.

Here, the midpoint 42B of the hypocycloid curve 426 is a point that symmetrically divides into two segments the hypocycloid curve 426 which is generated by rolling the inscribed-rolling circle Bo by one turn on the base circle Do of the outer rotor 420 without slippage. In other words, the midpoint 42B is a point that is reached by a specific point on the inscribed-rolling circle Bo which draws the hypocycloid curve 426 when the inscribed-rolling circle Bo rolls a half turn.

Next, as shown in FIG. 9B, the curve segments 426*a* and 426*b* are moved along a tangential line 42*q* of the hypocycloid curve 426 drawn at the midpoint 42B thereof so that the ends of the curve segments 426*a* and 426*b* are respectively connected to the ends of the curve segment 427*a* and 427*b*. As a result, the curve segments 426*a* and 426*b* overlap each other while intersecting each other at the midpoint 42*b*. Here, it is preferable to move two curve segments 426*a* and 426*b* by equal distance along the tangential line 42*q*, respectively, in a direction toward each other.

Moreover, as shown in FIG. 9C, the curve segments 426*a* and 426*b* are moved along the circumference of the base circle Do so that the ends of the curve segments 426*a* and 426*b* are respectively connected to the ends of the continuous curve that forms the tooth space 423. Here, it is preferable to move two curve segments 426*a* and 426*b* by equal distance along the circumference, respectively, in a direction toward each other.

As shown in FIG. 9D, the curve segments 426*a* and 426*b* are smoothly connected to each other so as to form a continuous curve that defines the tooth profile of the tooth tip 422.

As a result, the circumferential width of the tooth tip 422 is less than that of a tooth tip which is formed just using the simple hypocycloid curve 426 by an amount corresponding to the complementary line 424 interposed in the tooth space 423.

As explained above, in the case of the internal teeth 421 of the outer rotor 420, the circumferential thickness of the tooth tip 422 is made to be smaller and the circumferential width of the tooth space 423 is increased when compared with the case in which tooth profiles are formed just using the epicycloid curve 427 and the hypocycloid curve 426 that are generated by the circumscribed-rolling circle Ao and the inscribed-rolling circle Bo, respectively.

Further, the distance β between two internal tooth curve segments 427*a* and 427*b* of the outer rotor 420 is set so as to satisfy the following inequality:

$$0.01\ [\mathrm{mm}] \leqq \beta$$

As a result, a circumferential clearance between the tooth surfaces of the inner rotor 410 and the outer rotor 420 is appropriately ensured, so that the silence property of an oil pump rotor assembly can be sufficiently improved.

Further, the distance β between two internal tooth curve segments 427*a* and 427*b* of the outer rotor 420 is set so as to satisfy the following inequality:

$$\beta \leqq 0.08\ [\mathrm{mm}]$$

As a result, the clearance between the tooth faces between the inner rotor 410 and the outer rotor 420 can be prevented from being too small, and locking in rotation, increase in wear, and reduction in service life of the oil pump rotor assembly can be prevented.

In the inner and outer rotors 410 and 420, because "α" and "β", i.e., the amounts of movement of the tooth curve segments are too small to be shown in linear scale, they are greatly enlarged in FIGS. 8A to 8D, and in FIGS. 9A to 9D in order to explain the detailed profiles of the tooth surfaces; therefore, the tooth profiles shown in FIGS. 8A to 8D, and in FIGS. 9A to 9D are distorted when compared with the actual tooth profiles shown in FIG. 1.

In the above embodiment, the circumferential thicknesses of both tooth space 413 of the inner rotor 410 and tooth space 423 of the outer rotor 420 are increased when compared with conventional cases; however, the present invention is not limited to this, and other configurations may be employed in which one of the tooth space 413 of the inner rotor 410 or tooth space 423 of the outer rotor 420 is made thicker, and the tooth profile of the other tooth space is formed using a cycloid curve without modification.

INDUSTRIAL APPLICABILITY

As described above, according to the oil pump rotor assembly of the present invention, at least one of the tooth profile of the inner rotor and the tooth profile of the outer rotor is formed by moving cycloid curves in the circumferential direction and/or along a tangential line of the tooth tip. Thus, a circumferential clearance between tooth surfaces is appropriately ensured. As a result, an oil pump rotor assembly having a high mechanical efficiency and reduced noise can be obtained.

Particularly, the distance "α" between the external tooth curve segments and the distance "β" between the internal tooth curve segments are set to be equal to or greater than 0.01 [mm]. Thus, impacts between the rotors and hydraulic pulsation due to a large clearance between the tooth surfaces may be prevented. As a result, an oil pump rotor assembly having a high mechanical efficiency and reduced noise can be obtained.

Furthermore, the distance "α" between the external tooth curve segments and the distance "β" between the internal tooth curve segments are set to be equal to or less than 0.08 [mm]. Thus, an appropriate clearance between the surfaces of the teeth of the inner and outer rotors can be ensured. As a result, an oil pump rotor assembly, which rotates smoothly and having a satisfactory service life, can be obtained.

The invention claimed is:

1. An oil pump rotor assembly comprising:

an inner rotor formed with n external teeth where n is a natural number;

an outer rotor formed with (n+1) internal teeth which are engageable with the external teeth; and a casing having a suction port for drawing fluid and a discharge port for discharging fluid, wherein the fluid is conveyed by drawing and discharging the fluid by volume change of cells formed between tooth surfaces of the inner and outer rotors during relative rotation between the inner and outer rotors engaging each other, wherein each of the tooth profiles of the outer rotor is formed such that the profile of a tooth space thereof conforms to an epicycloid curve which is generated by rolling a circumscribed-rolling circle Ao along a base circle Do without slippage, and the profile of a tooth tip thereof conforms to a hypocycloid curve which is generated by rolling an inscribed-rolling circle Bo along the base circle Do without slippage, wherein the profile of a tooth tip of the inner rotor conforms to an epicycloid curve which is generated by rolling a circumscribed-rolling circle Ai along a base circle Di without slippage, wherein the profile of a tooth space of the inner rotor conforms to a hypocycloid curve, which is generated by rolling an inscribed-rolling circle Bi along a base circle Di without slippage, the hypocycloid curve is equally divided into two external tooth curve segments, the obtained two external tooth curve segments are separated from each other by a predetermined distance along the circumference of the base circle Di and/or along a tangential line of the hypocycloid curve drawn at the midpoint thereof, and the separated two external tooth curve segments are smoothly connected to each other using a curved line or a straight line, and wherein the inner and outer rotors are formed such that the following equations are satisfied:

$$\phi Ai=\phi Ao;$$

$$\phi Bi=\phi Bo;$$

$$\phi Ai+\phi Bi=\phi Ao+\phi Bo=2e;$$

$$\phi Do=(n+1)\cdot(\phi Ao+\phi Bo);$$

$$\phi Di=n\cdot(\phi Ai+\phi Bi);$$

$$n\cdot\phi Do=(n+1)\cdot\phi Di,$$

where ϕDi is the diameter of the base circle Di of the inner rotor, ϕAi is the diameter of the circumscribed-rolling circle Ai, ϕBi is the diameter of the inscribed-rolling circle Bi, ϕDo is the diameter of the base circle Do of the outer rotor, ϕAo is the diameter of the circumscribed-rolling circle Ao, ϕBo is the diameter of the inscribed-rolling circle Bo, and "e" is an eccentric distance between the inner and outer rotors, and such that the following equation is satisfied:

$$0.01\ [\mathrm{mm}]\leqq\alpha\leqq0.08\ [\mathrm{mm}]$$

where "α" is the distance between the separated external tooth curve segments in the inner rotor.

2. An oil pump rotor assembly comprising:

an inner rotor formed with n external teeth where n is a natural number;

an outer rotor formed with (n+1) internal teeth which are engageable with the external teeth; and a casing having a suction port for drawing fluid and a discharge port for discharging fluid, wherein the fluid is conveyed by drawing and discharging the fluid by volume change of cells formed between tooth surfaces of the inner and outer rotors during relative rotation between the inner and outer rotors engaging each other, wherein each of the tooth profiles of the inner rotor is formed such that the profile of a tooth tip thereof conforms to an epicycloid curve which is generated by rolling a circumscribed-rolling circle Ai along a base circle Di without slippage, and the profile of a tooth space thereof conforms to a hypocycloid curve which is generated by rolling an inscribed-rolling circle Bi along the base circle Di without slippage, wherein the profile of a tooth tip of the outer rotor conforms to a hypocycloid curve which is formed by rolling an inscribed-rolling circle Bo along a base circle Do without slippage, wherein the profile of a tooth space of the outer rotor conforms to an epicycloid curve, which is generated by rolling a circumscribed-rolling circle Ao along a base circle Do without slippage, the epicycloid curve is equally divided into two internal tooth curve segments, the obtained two internal tooth curve segments are separated from each other by a predetermined distance along the circumference of the base circle Do and/or along a tangential line of the epicycloid curve drawn at the midpoint thereof, and the separated two internal tooth curve segments are smoothly connected to each other using a curved line or a straight line, wherein the inner and outer rotors are formed such that the following equations are satisfied:

$$\phi Ai=\phi Ao;$$

$$\phi Bi=\phi Bo;$$

$$\phi Ai+\phi Bi=\phi Ao+\phi Bo=2e;$$

$$\phi Do=(n+1)\cdot(\phi Ao+\phi Bo);$$

$$\phi Di=n\cdot(\phi Ai+\phi Bi);$$

$$n\cdot\phi Do=(n+1)\cdot\phi Di,$$

where ϕDi is the diameter of the base circle Di of the inner rotor, ϕAi is the diameter of the circumscribed-rolling circle Ai, ϕBi is the diameter of the inscribed-rolling circle Bi, ϕDo is the diameter of the base circle Do of the outer rotor, ϕAo is the diameter of the circumscribed-rolling circle Ao, ϕBo is the diameter of the inscribed-rolling circle Bo, and "e" is an eccentric distance between the inner and outer rotors, and such that the following equation is satisfied:

$$0.01\ [\mathrm{mm}]\leqq\beta\leqq0.08\ [\mathrm{mm}]$$

where "β" is the distance between the separated internal tooth curve segments in the outer rotor.

3. An oil pump rotor assembly comprising:

an inner rotor formed with n external teeth where n is a natural number;

an outer rotor formed with (n+1) internal teeth which are engageable with the external teeth; and a casing having a suction port for drawing fluid and a discharge port for discharging fluid, wherein the fluid is conveyed by drawing and discharging the fluid by volume change of cells formed between tooth surfaces of the inner and outer rotors during relative rotation between the inner and outer rotors engaging each other, wherein the profile of a tooth tip of the inner rotor conforms to an epicycloid curve which is generated by rolling a circumscribed-rolling circle Ai along a base circle Di without slippage, wherein the profile of a tooth space of the inner rotor conforms to a hypocycloid curve, which is generated by rolling an inscribed-rolling circle Bi along a base circle Di without slippage, the hypocycloid curve is equally divided into two external tooth curve segments, the obtained two external tooth curve segments are separated from each other by a predetermined distance along the circumference of the base circle Di and/or along a tangential line of the hypocycloid curve drawn at the midpoint thereof, and the separated two external tooth curve segments are smoothly connected to each other using a curved line or a straight line, wherein the profile of a tooth tip of the outer rotor conforms to a hypocycloid curve which is generated by rolling an inscribed-rolling circle Bo along a base circle Do without slippage, wherein the profile of a tooth space of the outer rotor conforms to an epicycloid curve, which is generated by rolling a circumscribed-rolling circle Ao along a base circle Do without slippage, the epicycloid curve is equally divided into two internal tooth curve segments, the two internal tooth curve segments are separated from each other by a predetermined distance along the circumference of the base circle Do and/or along a tangential line of the epicycloid curve drawn at the midpoint thereof, and the separated two internal tooth curve segments are smoothly connected to each other using a curved line or a straight line, wherein the inner and outer rotors are formed such that the following equations are satisfied:

$$\phi Ai=\phi Ao;$$

$$\phi Bi=\phi Bo;$$

$$\phi Ai+\phi Bi=\phi Ao+\phi Bo=2e;$$

$$\phi Do=(n+1)\cdot(\phi Ao+\phi Bo);$$

$$\phi Di=n\cdot(\phi Ai+\phi Bi);$$

$$n\cdot\phi Do=(n+1)\cdot\phi Di,$$

where $\phi$Di is the diameter of the base circle Di of the inner rotor, $\phi$Ai is the diameter of the circumscribed-rolling circle Ai, $\phi$Bi is the diameter of the inscribed-rolling circle Bi, $\phi$Do is the diameter of the base circle Do of the outer rotor, $\phi$Ao is the diameter of the circumscribed-rolling circle Ao, $\phi$Bo is the diameter of the inscribed-rolling circle Bo, and "e" is an eccentric distance between the inner and outer rotors, and such that the following equation is satisfied:

$$0.01\ [\text{mm}]\leqq\alpha\leqq0.08\ [\text{mm}]$$

$$0.01\ [\text{mm}]\leqq\beta\leqq0.08\ [\text{mm}]$$

where "$\alpha$" is the distance between the separated external tooth curve segments in the inner rotor, and "$\beta$" is the distance between the separated internal tooth curve segments in the outer rotor.

* * * * *